US006659066B1

(12) United States Patent
Lee

(10) Patent No.: US 6,659,066 B1
(45) Date of Patent: Dec. 9, 2003

(54) GEAR SYNCHRONIZED ARTICULATED VANE ROTARY MACHINE

(76) Inventor: Charles Matthew Lee, 837 Spence Cir., Virginia Beach, VA (US) 23462

( * ) Notice: Subject to any disclaimer, the term of this patent is extended or adjusted under 35 U.S.C. 154(b) by 0 days.

(21) Appl. No.: 10/177,883

(22) Filed: Jun. 24, 2002

(51) Int. Cl.[7] ..... F02B 53/00
(52) U.S. Cl. ..... 123/243
(58) Field of Search ..... 123/243, 204, 123/221, 223, 224, 227, 231

(56) References Cited

U.S. PATENT DOCUMENTS 3,511,584 A * 5/1970 Vierling ..... 123/243
3,955,540 A * 5/1976 Blanchard ..... 418/256
4,225,308 A * 9/1980 Lohn ..... 433/132
5,979,395 A * 11/1999 Mallen et al. ..... 123/243
6,349,695 B1 * 2/2002 Lee ..... 123/227
6,536,403 B1 * 3/2003 Elsherbini ..... 123/243
6,599,113 B1 * 7/2003 Lee ..... 418/256

* cited by examiner

*Primary Examiner*—Sheldon J. Richter

(57) ABSTRACT

An independent radial vane rotary machine for the production of rotary mechanical power through internal combustion of liquid or gaseous fuel and employing intermeshed gearing for synchronization of major rotational components. The machine functions in general accordance with the principles of the Carnot heat engine cycle but mechanical manipulation of working fluid is accomplished without reciprocating mechanical components and combustion is performed as a continuously sustained process. The machine offers vibration-free operation and good measures of functional efficiency, power density, and inherent reliability. The disclosure presents the geometric and mechanical features necessary to demonstrate functional viability.

1 Claim, 21 Drawing Sheets

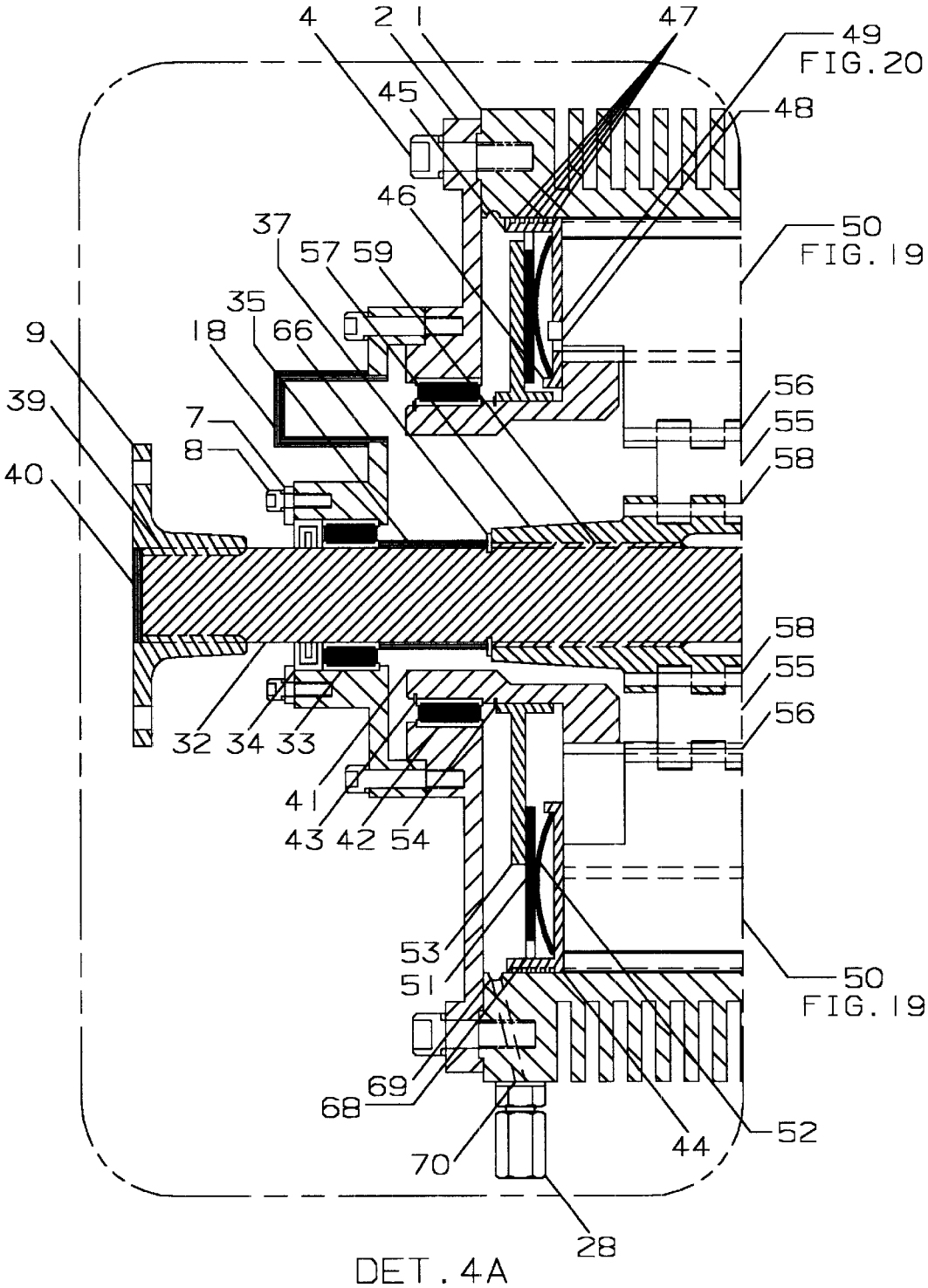
DET.4A

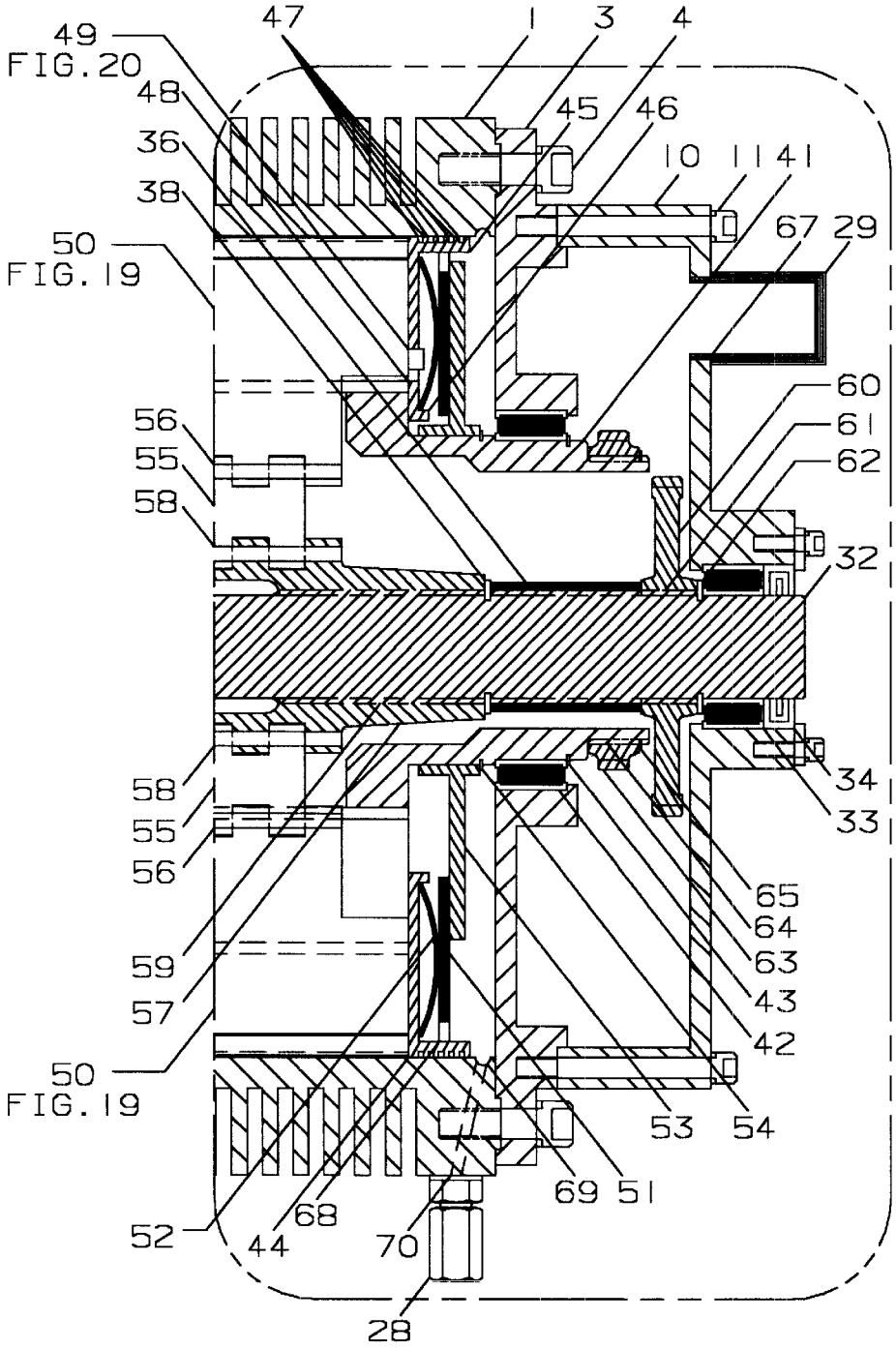
DET.4B

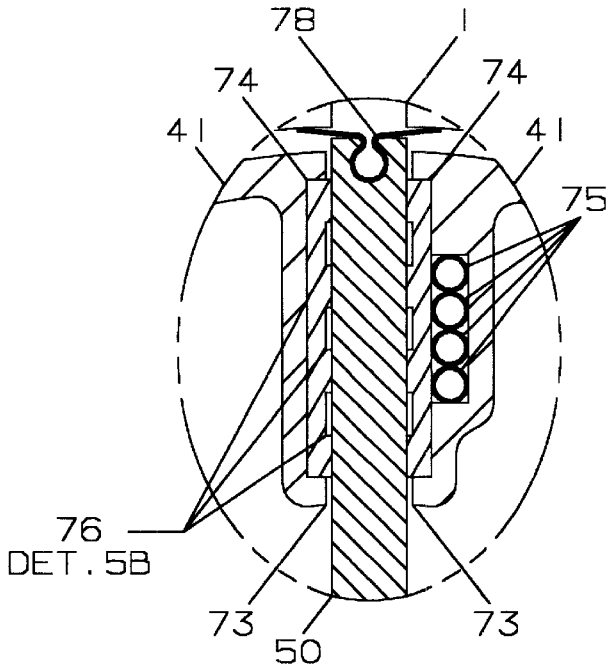
DET. 5A
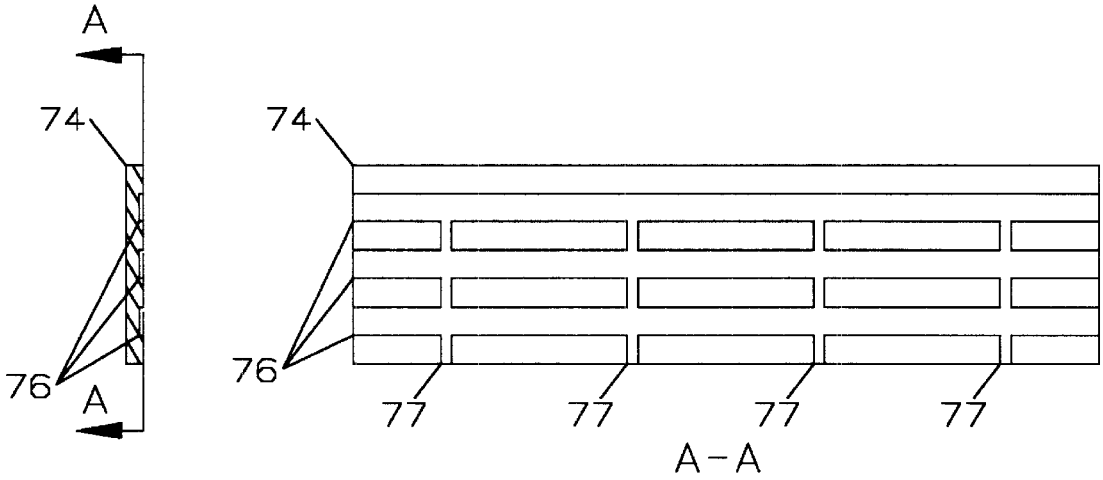
DET. 5B

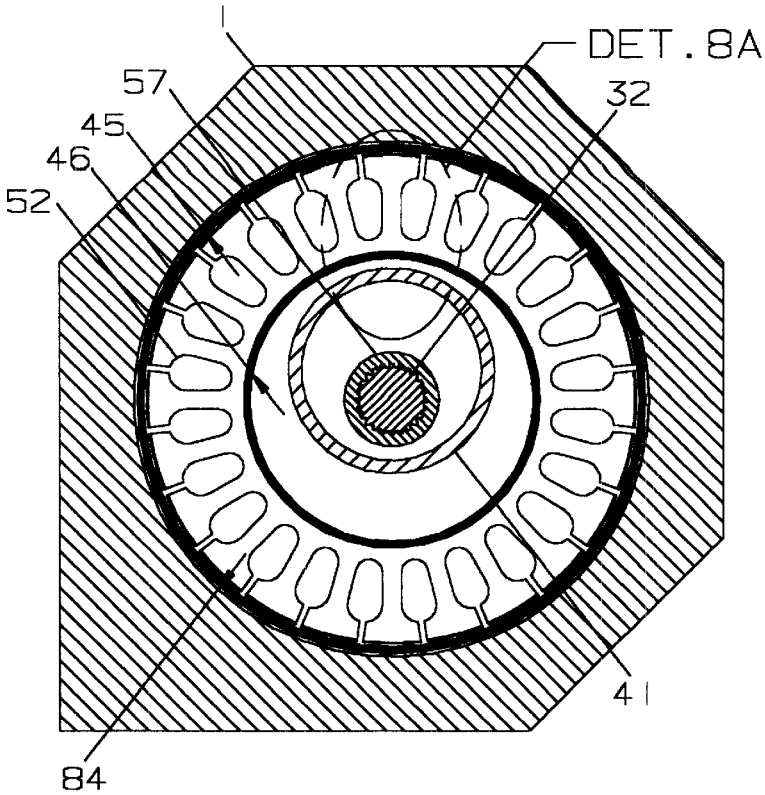
FIG. 8
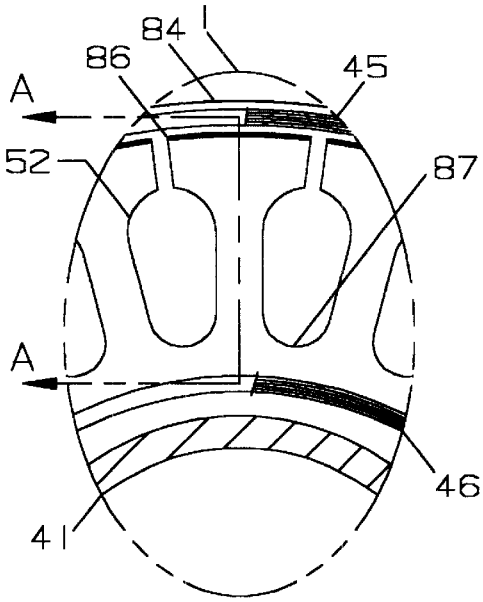
DET. 8A
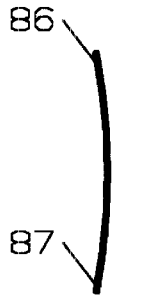
A-A

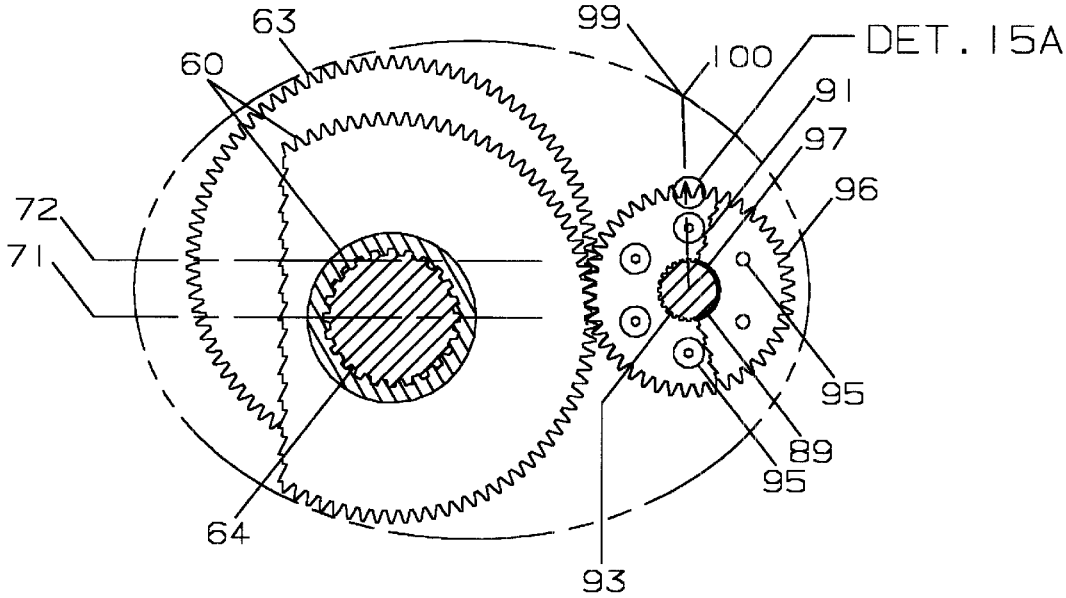
FIG. 15
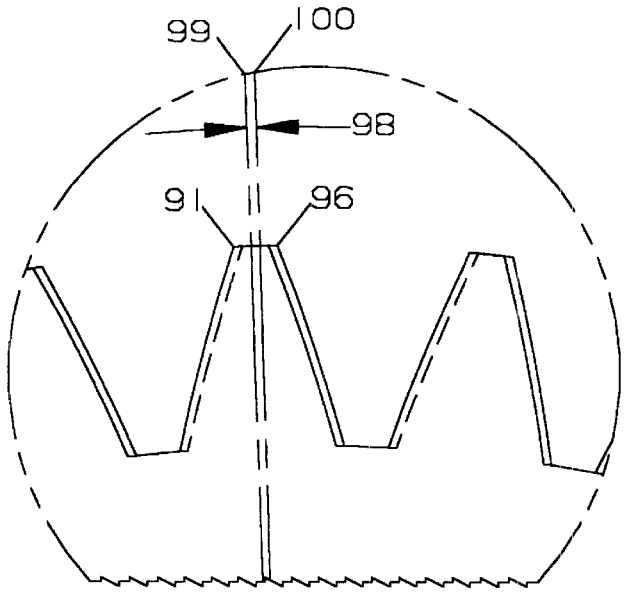
DET. 15A

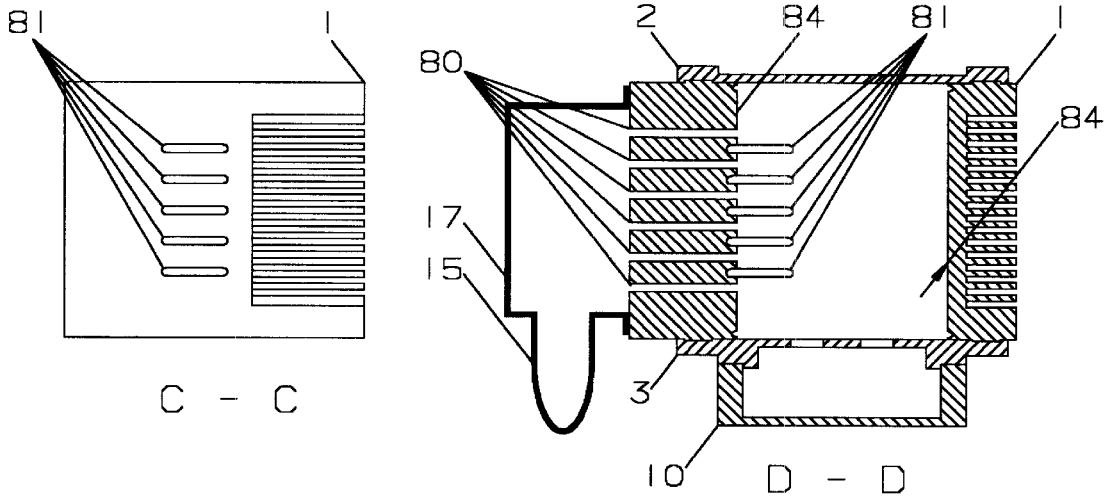
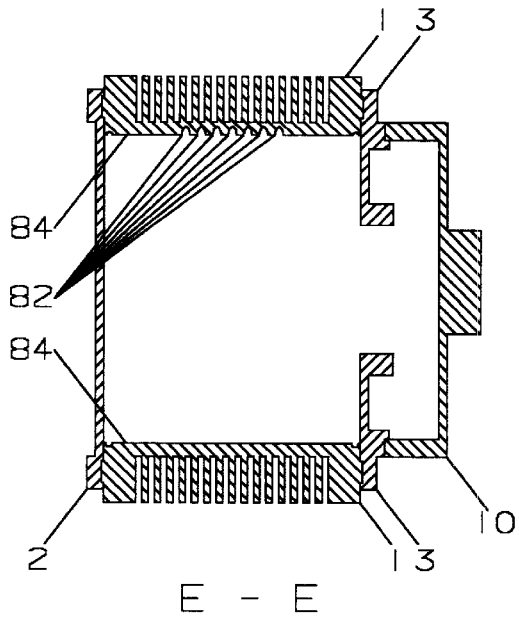
FIG. 18 - CONTINUED

GEAR SYNCHRONIZED ARTICULATED VANE ROTARY MACHINE

CROSS REFERENCE TO RELATED APPLICATIONS

Not applicable

STATEMENT REGARDING FEDERALLY FUNDED RESEARCH OR DEVELOPMENT

No products of Federally Funded Research or Development are reflected in, or referenced in, this disclosure.

REFERENCE TO A MICROFICHE APPENDIX

No Microfiche Appendix is included in this application.

BACKGROUND OF THE INVENTION

At the present time, machines employed for the production of mechanical energy by internal combustion of organic fuel consist primarily of mechanical displacement reciprocating engines and gas turbines.

Reciprocating engines employ reciprocating pistons and valves to accomplish working fluid manipulation and fuel combustion occurs as a periodic process. The functional principles of the reciprocating internal combustion engine are described in terms of the theoretical thermodynamic cycle postulated by Sadi Carnot in 1824 or in terms of one of the theoretical thermodynamic cycles subsequentially postulated by Nicholas Otto in 1876 and Rudolph Diesel in 1892. Gas turbines employ purely rotational aerodynamically interacting components to accomplish working fluid manipulation and fuel combustion is a self-sustaining continuous process. In general, gas turbines theoretically function in accordance with a thermodynamic cycle as postulated by G. B. Breyton in 1876.

Reciprocating engines are economically satisfactory power sources for many commercial applications but are mechanically complex and the reciprocating components and the periodic combustion process are inherent sources of undesirable noise and vibration. In comparison, gas turbine machines characteristically offer the attributes of relatively higher power density and reduced emissions of noise and vibration but offer economic superiority only in applications requiring relatively high measures of delivered power.

Over a number of years significant inventive effort has been directed toward the derivation of a "rotary" internal combustion machine that give the performance characteristics of reciprocating engines but preclude their concomitant mechanical complexity and potential for emission of noise and vibration. The radial vane type rotary machine has been the subject of particular attention in this regard.

Conceptually the rotary vane machine primarily consists of a stationary housing containing a rotationally dynamic mechanical assembly. The stationary housing consists of a containment cylinder installed with end closure structures and ports for movement of combustion air and combustion products through the structural boundary. The rotationally dynamic mechanical assembly primarily consists of a rotational armature and a set of radial vanes. Said rotational armature is precisely or approximately circular in cross section and is concentrically secured on a rotational shaft. Said rotational shaft is constrained by rotational bearings with its rotational axis parallel to but radially displaced from the bore axis of said containment cylinder and its axial ends are configured to interface with external rotational power machines. Said rotational armature is proportioned to have an effective diameter significantly less than the bore diameter of said containment cylinder in order to create an annular space around its periphery. Said rotational armature is fitted with a number of axially oriented radial vane slots equally distributed around its periphery. Each radial vane slot accommodates and provides annular sliding support for one radial vane. Each said radial vane is proportioned to axially extend through the axial length of said rotational armature and radially extend from within said radial vane slot to the bore of said containment cylinder. The set of radial vanes thus subdivides the annular space surrounding said rotational armature into a number of segmental chambers. Since the rotational axis of said rotational armature is radially displaced from the bore axis of said containment cylinder, the relative volume of any said segmental chamber is dependent upon its orbital location and is cyclically changed through rotation of said rotational armature. The dynamic relationship between rotational armature rotation and relative segmental chamber volume is functionally analogous to the relationship between relative cylinder volume and crankshaft rotation as occurs in reciprocating type internal combustion machines and provides the working fluid manipulation features necessary for evolution of a Carnot type heat engine cycle. For a given set of containment cylinder proportions, the manipulated volume is inversely influenced by the diameter of said armature. Within certain limits, the effective compression ratio of the volumetric cycle is directly influenced by both the number of segmental chambers surrounding said rotational armature and the distance separating the rotational axis of said rotational armature from the bore axis of said containment cylinder. Said effective compression ratio is also influenced by the angular width and orbital location of the sectors allocated for the combustion air supply port and for the combustion product discharge port.

A number of patents have been awarded for rotary vane internal combustion machine concept but, despite the potentially excellent qualities offered by the machine, none of the concepts presented in prior art are known to have matured sufficiently to demonstrate practical utility. It is hypothesized that such non-maturation is the result of singular or compounded inadequacies regarding the functional viability of the perceived entities. As known to persons skilled in the art, the fundamental functional viability of all machines is dependent upon their compatibility with natural laws related to physics, mathematics, and chemistry. It is also known that the functional viability of an energy related machine is dependent upon its capability to meet thresholds for overall efficiency and reliability within constraints imposed by economic considerations. Overall efficiency of a thermal machine is critically dependent upon attaining certain minimum thresholds for both thermodynamic cycle efficiency and mechanical efficiency and functional reliability is critically dependent upon maintaining component temperatures within thresholds prescribed by material characteristics. For these reasons the potential functional viability of a thermal machine may be assessed by analytical review of its functional geometry and component features relative to heat cycle efficiency, mechanical efficiency, and thermal management considerations.

For internal combustion machines based on Carnot principles and with numerically equal compression and expansion ratios, the basic relationship between cycle efficiency ("Air Standard Efficiency") and the effective compression ratio is:

$$\eta_c = 1 - \frac{1}{v^{(k-1)}}$$

Where:

$\eta_c$ = Cycle Efficency $v$ = Effective Compression Ratio $k$ = Universal Gas Constant The relationship shown above demonstrates that heat cycle efficiency is favorably influenced by the magnitude of the compression ratio accomplished within the volumetric manipulation. As previously noted, the effective compression ratio of a rotary vane machine is directly influenced by the number of the annular segmental chambers surrounding the armature and the distance between the rotational armature axis and containment cylinder bore axis. Analysis demonstrates that the threshold for adequate cycle efficiency is attained only if the number of segmental chambers surrounding the rotational armature and the distance between the rotational armature axis and containment cylinder bore axis both exceed certain minimum values.

Mechanical efficiency is essentially the measure of mechanical energy conservation exhibited by a mechanism in the process of doing work. Mechanical efficiency is adversely influenced by the quantity of energy dissipated by frictional interaction between dynamically interfacing components and in this context may simply be expressed as:

$$\eta_m = \frac{P_i - P_f}{P_i}$$

Where:

$\eta_m$ = Mechanical Efficency $P_i$ = Input Power $P_f$ = Power Consumed by Internal Friction Power consumed by internal friction is the sum of the increments of power consumed by individual frictional components. In radial vane type rotary machines the radial vanes create the preponderance of the dynamically active mechanical interfaces and are, thereby, a particularly significant potential cause of power loss due to friction. Potential friction sources are; a) peripheral edge friction caused by sliding contact of said radial vanes with bore of the stationary containment cylinder, b) axial end friction caused by sliding contact of axial ends of the radial vanes with non-rotating end closure components, and c) radial friction caused by sliding contact of the faces of radial vanes with the supporting surfaces of rotational armature. The magnitude of energy loss due to friction is also significantly influenced by the nature of the materials in sliding contact and the effectiveness of lubrication at the contact surface. Analysis demonstrates that without deliberate friction reduction the number of radial vanes necessary to achieve functional viability from a thermodynamic cycle efficiency viewpoint could, alone, incur sufficient friction to cause the machine to be non-viable from a mechanical efficiency viewpoint.

Internal combustion machine components are exposed to heat from three sources, adiabatic compression, fuel combustion, and friction. Component temperature must be constrained with certain thresholds in order to avoid performance degradation through thermal expansion, strength reduction, or lubricant failure. For these reasons the functional viability of internal combustion machines is dependent upon adequate thermal control. Thermal control normally consists of the movement of liquid and/or gaseous heat extraction media across component surfaces and, in general, the rate of heat extraction is directly influenced by both the surface area and flow rate of heat extraction media. Thermal control for stationary enclosures is readily accomplished by exposure of external surfaces to ambient air or by movement liquid heat extraction media through integral passageways. Thermal control for internal mechanically dynamic components is normally accomplished by circulation of air and liquid lubricant. In the case of reciprocating machines the internal mechanically dynamic components are substantially isolated from high temperature working fluid and they are conveniently exposed to internal thermal control media contained within a stationary crankcase. In comparison the internal mechanically dynamic components of rotary vane machines are relatively more substantially exposed to contact with high temperature working fluid and significantly less conveniently exposed to thermal control media. For these reasons the means for maintaining internal thermal control is a vital issue regarding the functional viability of rotary vane thermal machines.

Rotary vane machine disclosures presented to date substantially focus on technical approaches toward minimization of friction and in particularly friction related to the relative motion between the radial vanes and the bore of the containment cylinder but, in general, they are substantially silent regarding the other functional viability issues discussed above. Principal features of several relevant prior disclosures are briefly reviewed below.

U.S. Pat. No. 2,590,132 discloses a rotary vane machine in which each radial vane is radially constrained by cylindrical extensions at each axial end one of which engages a rotating ring and the other engages a rotating disk. An annular cylinder is coaxially secured to both said rotating ring and said rotating disk and is axially and radially constrained by a rotational bearing installed in a stationary structure at one axial end. Said annular cylinder is installed with axially aligned radial slots with each slot proportioned to accommodate and permit radial movement of one said radial vane and with axially aligned sealing strips secured on its outer periphery and proportioned to maintain sliding contact with the bore of a stationary housing. Each said radial vane is radially constrained to maintain a small distance between its radially outermost axial edge and the bore of said stationary housing. A spring loaded sliding seal is installed on the radially outermost axial edge of each said radial vane and proportioned to maintain pressure contact with the bore of said stationary housing. Lubrication and thermal control issues are not discussed.

U.S. Pat. No. 5,568,796 discloses an independent vane rotary machine in which each radial vane is radially constrained by pivotal bearings installed on a rotating hub. Each said radial vane is radially proportioned to extend through a rotating circular annulus installed on rotational bearings and aligned with its rotational axis parallel to but separate from the rotational axis of said hub. Gears maintain said hub and said circular annulus in synchronous rotation. The bore of said stationary housing is contoured and each said radial vane is proportioned to maintain a constant distance of separation between the radially outermost axial edge of said radial vane and the bore of said stationary housing. A seal is installed on the outermost axial edge of each said radial vane to close the gap between said radial vane and the bore of said stationary housing. The disclosure demonstrates that one said assembly fulfills the functional requirements of a gaseous fluid compressor and also demonstrates that two such assemblies mechanically coupled can collectively fulfill the functional requirements of a heat engine cycle. The disclosure is silent regarding means for sealing the axial ends of segmental chambers, centrifugal restraint of vane edge seals and issues related to lubrication and thermal control for internal components.

U.S. Pat. No. 5,709,188 discloses an independent vane rotary machine in which each radial vane is radially constrained by a mechanical link installed on its radially innermost axial edge and radially extends through a rotational annulus. Said rotational annulus is aligned with its rotational axis parallel to but separate from the bore of a stationary housing. A stationary cam is axially secured at one axial end of the stationary housing. Rotational motion of said rotational annulus causes interaction of said stationary cam and said mechanical link to induce cyclical radial movement of said radial vane. The bore of said stationary housing is contoured and each said radial vane is proportioned to maintain a constant distance of separation between the radially outermost axial edge said radial vane and the bore of said stationary housing. A seal is installed on the radially outermost axial edge of each said radial vane and radially constrained by direct contact with the bore of said stationary housing. The disclosure demonstrates that two such assemblies rotationally coupled can collectively fulfill the functional requirements of a heat engine cycle. The disclosure presents an approach for lubrication by centrifugally induced circulation of liquid media but is silent regarding means for closing the axial ends of segmental chambers and means for thermal control for internal components.

U.K. Pat. No. 468,390 presents improvements in and relating to rotary piston machines and features uninterrupted combustion of fuel at constant pressure, combustion of different fuel types and control by throttle like devices. The disclosure also demonstrates that two rotary vane machines may be non-mechanically coupled to collectively fulfill the four functional phases of a heat engine cycle. Disclosure drawings illustrate a rotary device consisting of a stationary containment cylinder, a rotational shaft and a solid rotor fitted with six radial vane slots and six radial vanes. The disclosure is silent regarding issues related to lubrication, thermal control and other functional viability considerations.

U.S. Pat. No. 6,024,549 discloses an independent vane rotary machine in which each radial vane is accommodated within a radial slot installed in a rotational annulus and each axial end of each said radial vane is radially constrained by an axially extended flange installed on the outer periphery of a rotating disk. Each said rotating disk is diametrically proportioned to closely approach a circular bore in a stationary containment cylinder and radially constrains said radial vane to maintain a constant distance between the radially outermost axial edge of said radial vane and said containment cylinder bore. A seal is installed on the outer axial edge of each said radial vane resiliently closes the gap between said radial vane and said containment cylinder bore. An axially extending compression spring is installed at each axial end of the rotational assembly. Each said axially extending compression spring is proportioned to induce resilient axial contact of its contiguous said rotating disk and the axial end of said rotational annulus and thus close the axial ends of segmental chambers but accommodate variations in component geometry caused by thermal expansion or mechanical loading. Disclosure includes a system for dispersion of thermal control and lubricant media within said rotational annulus and for extraction of condensate and excess lubricant.

U.S. Pat. No. 6,349,695 discloses an independent rotary vane rotary machine in which each radial vane is radially constrained by radial vane retainer concentrically secured on a rotational shaft. Each said radial vane is accommodated within a radial slot installed in a rotational annulus. Each said radial slot in said rotational annulus additionally accommodates and annularly constrains one pair of radially extending compression springs. Said radially extending compression springs are constrained and proportioned to resiliently maintain said rotational annulus and said rotational shaft in synchronous rotation. An articulated radial vane extension is installed between each said radial vane and said radial vane retainer and each said articulated radial vane extension is proportioned to maintain a constant distance between the outer axial edge of each said radial vane and the circular bore of a stationary containment cylinder. A seal installed on the outer axial edge of each said radial vane is proportioned to resiliently close the gap between the outer axial edge said radial vane and the bore of said stationary housing. One rotating disk diametrically proportioned to closely approach the bore of said stationary containment cylinder is installed at each axial end of said rotational annulus and one axially extending compression spring is installed at each axial end of the rotational assembly. Said axially extending compression spring is proportioned to induce the contiguous said rotating disk to make resilient axial contact with the axial end of said annulus and thus close the axial ends of segmental chambers but accommodate variations in component geometry caused by thermal expansion or mechanical loading. Disclosure includes a system for the movement of thermal control and lubricant media within said rotor annulus and for extraction of excess lubricant.

It is believed that none of the above disclosures taken singly or combination describes the form and functional features of the invention presented in this disclosure.

BRIEF SUMMARY OF THE INVENTION

This disclosure presents a rotary vane internal combustion machine for efficient production of rotational mechanical energy through internal combustion of liquid or gaseous fuel. The machine functions in general accordance with the principles of the Carnot heat engine cycle but mechanical manipulation of working fluid is accomplished without the use of reciprocating components and combustion is performed as a continuously sustained process. The machine primarily consists of a stationary containment and foundation structure and an internal rotationally dynamic mechanical assembly.

The stationary containment and foundation structure consists of a containment cylinder with circular bore installed with a closure structure at each axial end. Ports for induction of combustion air and discharge of combustion products are mutually interspersed throughout the axial length of said containment cylinder and are peripherally dispersed and radially oriented to minimize their collective sector width and to symbiotically promote their functional efficiency. Additional ports are also installed as required for induction of fuel, externally supplied ignition energy, and internal thermal control and lubrication media, and for maintaining continuous internal combustion.

The internal rotationally dynamic assembly primarily consists of one rotational armature, one rotational shaft, a synchronizing gear set, and a set of radial vanes. Said rotational armature features a circular cross section proportioned with an outside diameter equal to approximately eighty five percent of the bore of said containment cylinder and is configured as a structural annulus. Said rotational armature is fitted with a number of axial radial vane slots uniformly distributed around its periphery with each said radial vane slot extending through its axial length and through its annulus thickness. Said rotational armature is simply supported by one low friction rotational bearing installed at each axial end and is aligned with its rotational axis parallel to but radially separated from the bore axis of said containment cylinder. Said rotational shaft axially passes through said rotational armature and a low-friction rotational bearing installed in each said end closure structure. Said rotational shaft is aligned to rotate on an axis parallel to but radially separated from the rotational axis of said rotational armature. The axial ends of said rotational shaft are configured as necessary to mechanically interface with external rotary power devices. A radial vane retainer is concentrically secured on said rotational shaft within said rotational armature.

Said synchronizing gear set maintains a fixed rotational relationship between said rotational armature and said rotational shaft. One main synchronizing gear is secured on one axial end of said rotational armature and one main synchronizing gear is adjacently secured on said rotational shaft. Both said rational armature main synchronizing gear and said rotational shaft main synchronizing gear are identical in pitch diameter and pitch. Said rational armature main synchronizing gear intermeshes with a peripheral rotational armature auxiliary synchronizing gear and said rotational shaft main synchronizing gear intermeshes with a peripheral rotational shaft auxiliary synchronizing gear. Both said rotational armature auxiliary synchronizing gear and said rotational shaft auxiliary synchronizing gear are identical in pitch diameter and pitch and share a common rotational axis. Said rotational armature auxiliary synchronizing gear and said rotational shaft auxiliary synchronizing gear are mechanically interlocked in the phase relationship necessary to maintain the appropriate rotational alignment of said rotational armature and said rotational shaft.

Each said radial vane slot accommodates one radial vane. Each said radial vane is free to radially slide between two axially aligned bearing surfaces. Each said radial vane is radially constrained by an articulated radial vane extension secured to its inner axial edge and secured to the outer periphery of said radial vane retainer. The radial extent of each said radial vane and each said articulated radial vane extension are proportioned to maintain a small gap between the outer axial edge of said radial vane and the bore of said containment cylinder. A mechanical radial vane edge seal is installed on the outer axial edge of each said radial vane to resiliently close the gap between said radial vane and the bore of said containment cylinder.

A freely rotating disk and axially extending compression spring are installed at each end of said rotational armature. Each said axial compression spring is proportioned to induce the axial face of its associated freely rotating disk to maintain axial contact with one axial end of said rotational armature to close the axial ends of segmental chambers, axially constrain the radial vanes, and resiliently accommodate variations in component geometry caused by thermal expansion and/or mechanical loading.

The internal axial cavity in said rotational armature is contoured to enlarge the surface area exposed to thermal control media and, hence, facilitate internal thermal control. Ports installed in said end closure structures and appropriate internal rotational components facilitate the axial movement of internal thermal control and lubrication media.

Necessary ancillary support items consist of an air supply fan, a fuel delivery system, an externally powered rotational device to initiate machine rotation, an electrically powered igniter to initiate combustion, and a lubricant management system.

The drawings presented in this disclosure illustrate the primary geometric and component features appropriate to obtaining the measures of thermodynamic efficiency, mechanical efficiency, and thermal control necessary for demonstration of functional viability.

BRIEF DESCRIPTION OF THE DRAWINGS

FIG. 4 is supported by enlarged illustrations DET. 4A and DET. 4B that highlight significant mechanical details. Please note that numerical identification of repeatedly illustrated identical items is constrained to the minimum deemed necessary for adequate presentation in order to avoid excessive nomenclature density. Cross section indicators given in FIG. 4 axially locate cross section illustrations later discussed.

FIG. 5 is supported by enlarged illustrations DET. 5A and DET5B.

FIG. 8 is a cross section to illustrate the geometric features of one annular axial compression spring. FIG. 8 is supported by enlarged illustration DET. 8A.

FIG. 15 is a compound cross section through the gear case to illustrate the integration of the rotational shaft and rotational armature synchronizing gears and the rotationally interlocking components. FIG. 15 is supported by enlarged illustration DET. 15A.

DETAILED DESCRIPTION OF THE INVENTION

Figure 1:
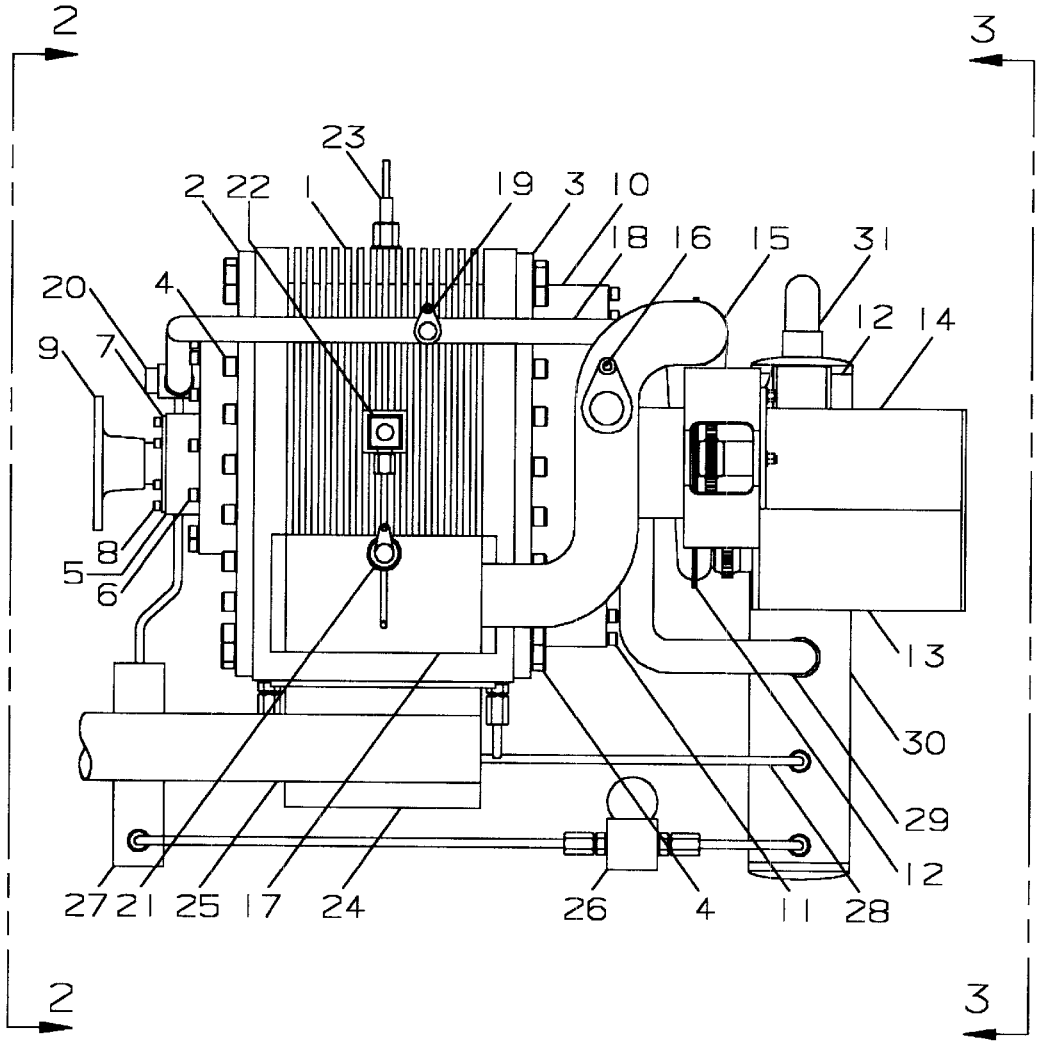
FIG. 1 is a side elevation to illustrate the axial disposition of components of the external general assembly. For the purposes of this disclosure the axis of rotation is horizontal and the machine is illustrated with diagrammatic representations of ancillary components deemed appropriate for combustion of liquid fuel.
Figure 2:
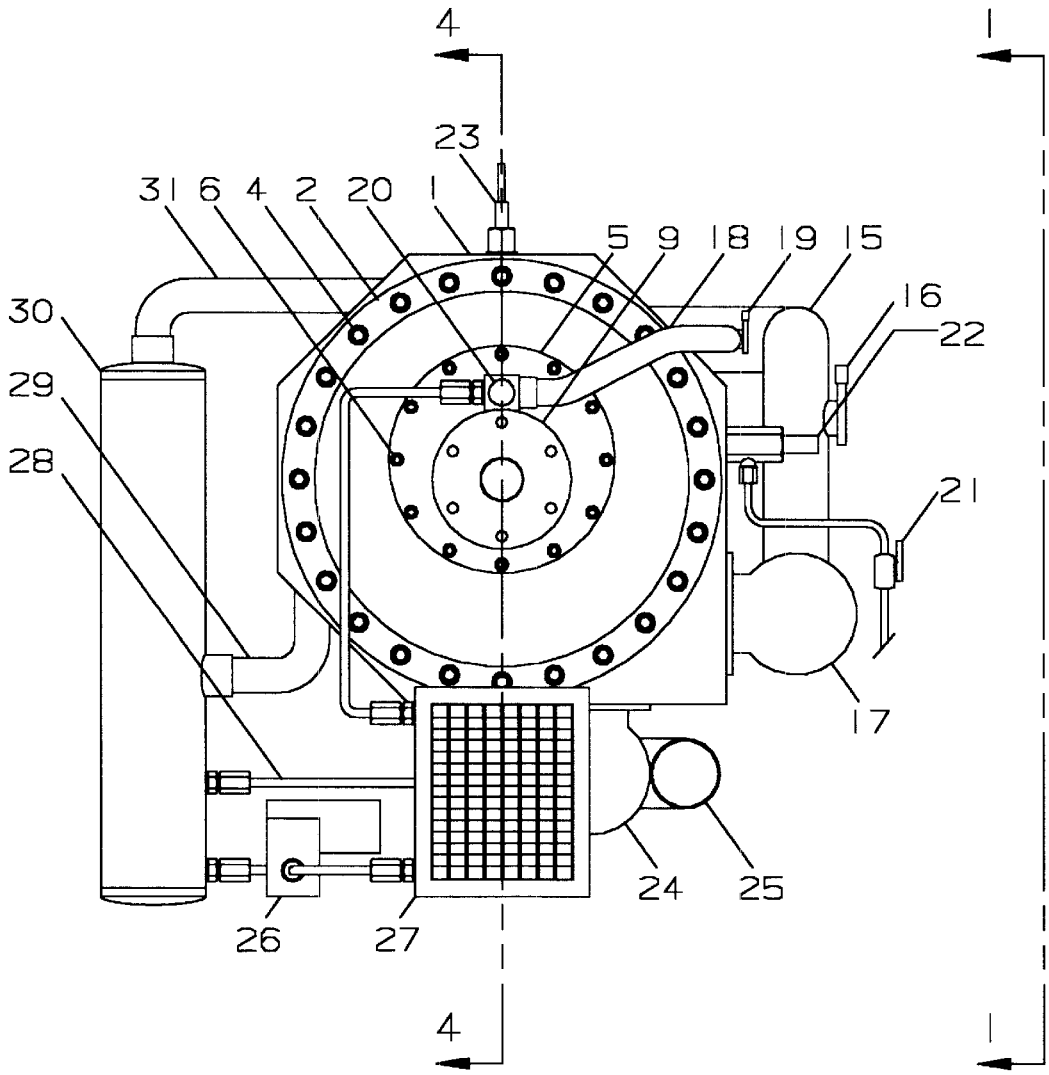
FIG. 2 and FIG. 3 are, respectively, left hand and right hand end views of the external general assembly relative to the elevation given in FIG. 1.
Figure 3:
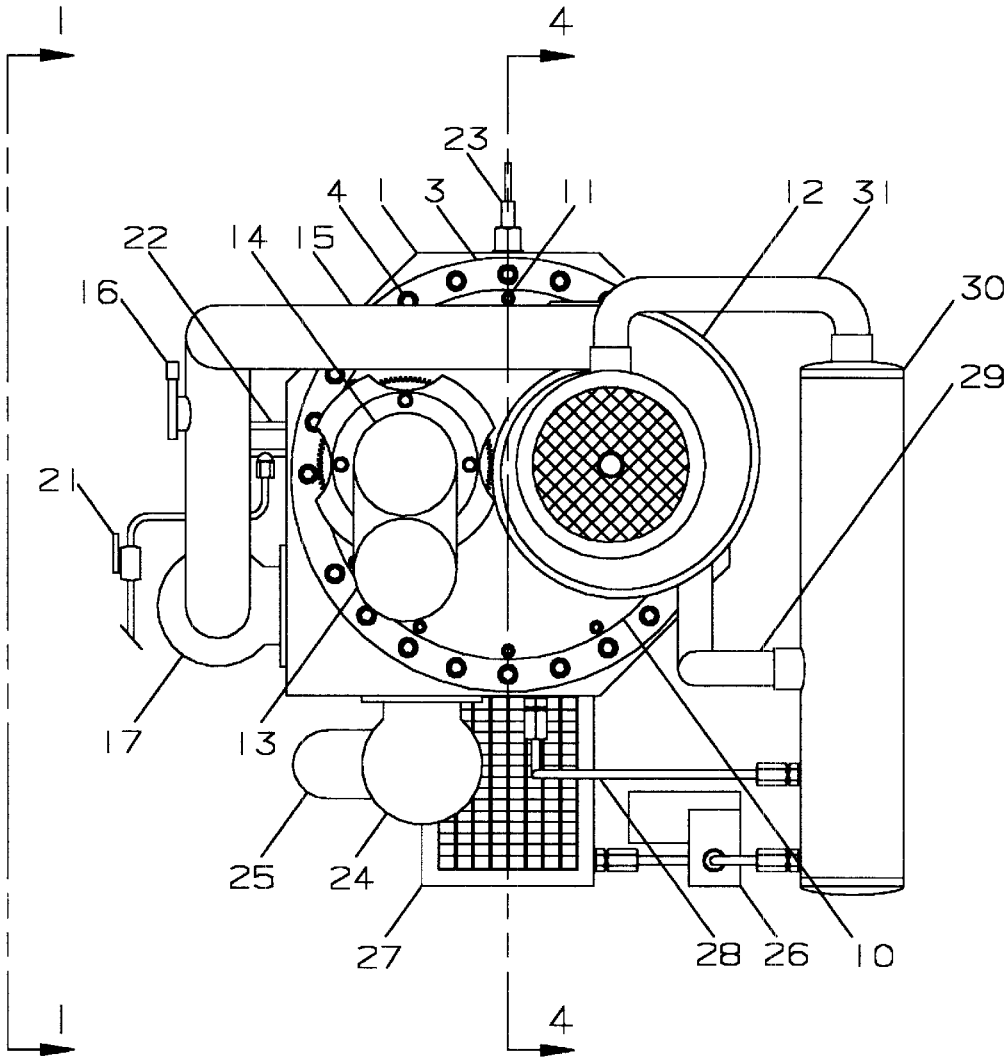

Referring to FIG. 1, FIG. 2 and FIG. 3, containment cylinder 1, end closure structure 2 and end closure structure 3 are the principal stationary containment and foundation components. Said containment cylinder 1 features a set of closely spaced fins to accomplish thermal control for external containment structure. Thermal control for external containment structure may also be accomplished by circulation of thermal control media through integral structural passageways. Said end closure structure 2 and said end enclosure structure 3 are mechanically secured to said containment cylinder 1 by machine screws 4. Rotational shaft bearing carrier 5 and bearing retainer 7 are secured by machine screws 6 and 8 respectively. Flange coupling 9 provides the interface for conduit of rotational mechanical energy to an external power transmission system. Integral gearbox 10 secured to end closure structure 3 by machine screws 11 contains synchronizing gears later discussed. Air supply fan 12 provides atmospheric air for combustion and internal thermal control. Externally energized device 13 provides rotational mechanical energy for initiation of rotation and electrical alternator 14 generates electrical energy to power peripheral auxiliary support systems. Conduit 15 conducts combustion air through control valve 16 to combustion air inlet manifold 17. Conduit 18 conducts internal thermal air control through control valve 19 to internal thermal control air and lubricant injector 20. Fuel control valve 21 and fuel injector 22 provide conduit for a controlled supply of liquid or gaseous fuel through the wall of said containment cylinder 1 for internal combustion. Electrical igniter 23 provides thermal input as necessary to initiate combustion. Manifold 24 and conduit 25 dispose of combustion product. Pump 26, heat exchanger 27, and said thermal control air and lubricant injector 20 deliver finely dispersed lubricant to internal mechanically dynamic components. Conduit 28 and conduit 29 respectively conduct excess lubricant and discharged internal thermal control air to lubricant coalescer and reservoir assembly 30. Conduit 31 vents said lubricant coalescer and reservoir assembly 30 to said air supply fan 12.

Figure 4:
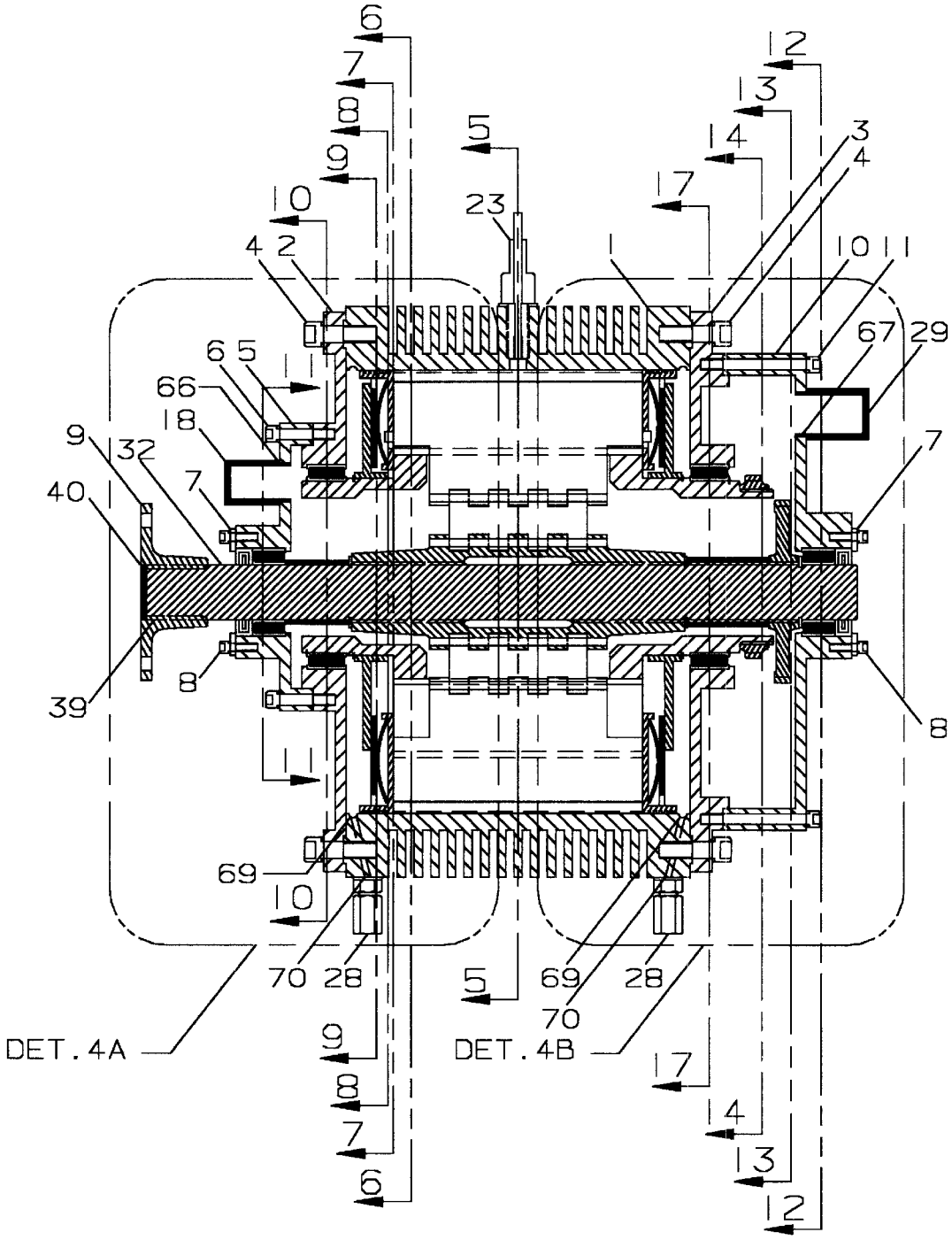
FIG. 4 is an axial section in the plane of the rotational axis to illustrate the axial disposition of significant internal components.

With reference to FIG. 4, DET. 4A and DET. 4B, rotational shaft 32 is radially constrained by one low-friction rotational shaft support bearing 33 installed near each axial end and axially constrained by annular collars 35, and 36 in conjunction with axial retainers 37 and 38. Each said rotational shaft support bearing 33 is protected from contamination by bearing seal 34 and is secured within its related bearing carrier by a bearing retainer 7. Flange coupling 9 is coaxially installed on rotational shaft 32, rotationally secured by rotational shaft spline 39, and axially secured by retainer 40. Rotational armature 41 is a hollow structural cylinder with a circular cross section and with an integrally connected hollow extension of reduced diameter at each axial end. Said rotational armature 41 is radially and axially constrained by one low-friction roller bearing 42 at each axial end. An axial retainer 43 secures each said bearing 42 within its related end closure structure. One axial seal ring 44 is installed at each axial end of said rotational armature 41. The outer diameter of each said axial seal ring 44 is proportioned to make a close tolerance sliding fit with the bore diameter of said containment cylinder 1. Each said axial seal ring 44 features an axially extended flange 45 on its outer periphery and an axially extended flange 46 on its inner periphery. Said axially extended flange 45 is fitted with circumferential channels 47. Axial opening 48 in each axial seal ring 44 accommodates one detent protrusion 49 installed on one radial vane 50. One wear ring 51 and one axial spring 52 are coaxially accommodated within the inner periphery of said axially extended flange 45. One axial retainer ring 53 is concentrically installed on each axial end of said rotational armature 41 and axially constrained by axial retainer 54. Each said axial spring 52 is proportioned to exert a resilient axial force to maintain resilient contact between the axial face of its adjacent axial seal ring 44 and the adjacent axial end of said rotational armature 41. Each said radial vane 50 is radially secured to the radially outermost axial edge of one articulated radial vane extension 55 by hinge pin 56. The radially innermost axial edge of each articulated said radial vane extension 55 is secured to radial vane retainer 57 by hinge pin 58. Radial vane retainer 57 is concentrically installed on said rotational shaft 32 and rotationally secured by mechanical spline 59. Rotational shaft main synchronizing gear 60 is concentrically installed on said rotational shaft 32 and secured by spline 61 and axial retainer 62. Rotational armature main synchronizing gear 63 is concentrically installed on said rotational armature 41 and secured by spline 64 and axial retainer 65. Conduit 18 in association with port 66 and conduit 29 in association with port 67 are interfaces for supply and discharge of internal thermal control air. Axial port 68 in said wear ring 51 provides conduit for axial movement of internal thermal control and lubrication media. Peripheral drain channel 69 and drain port 70 provide conduit for discharge of excess liquid lubricant to discharge conduit 28.

Figure 5:
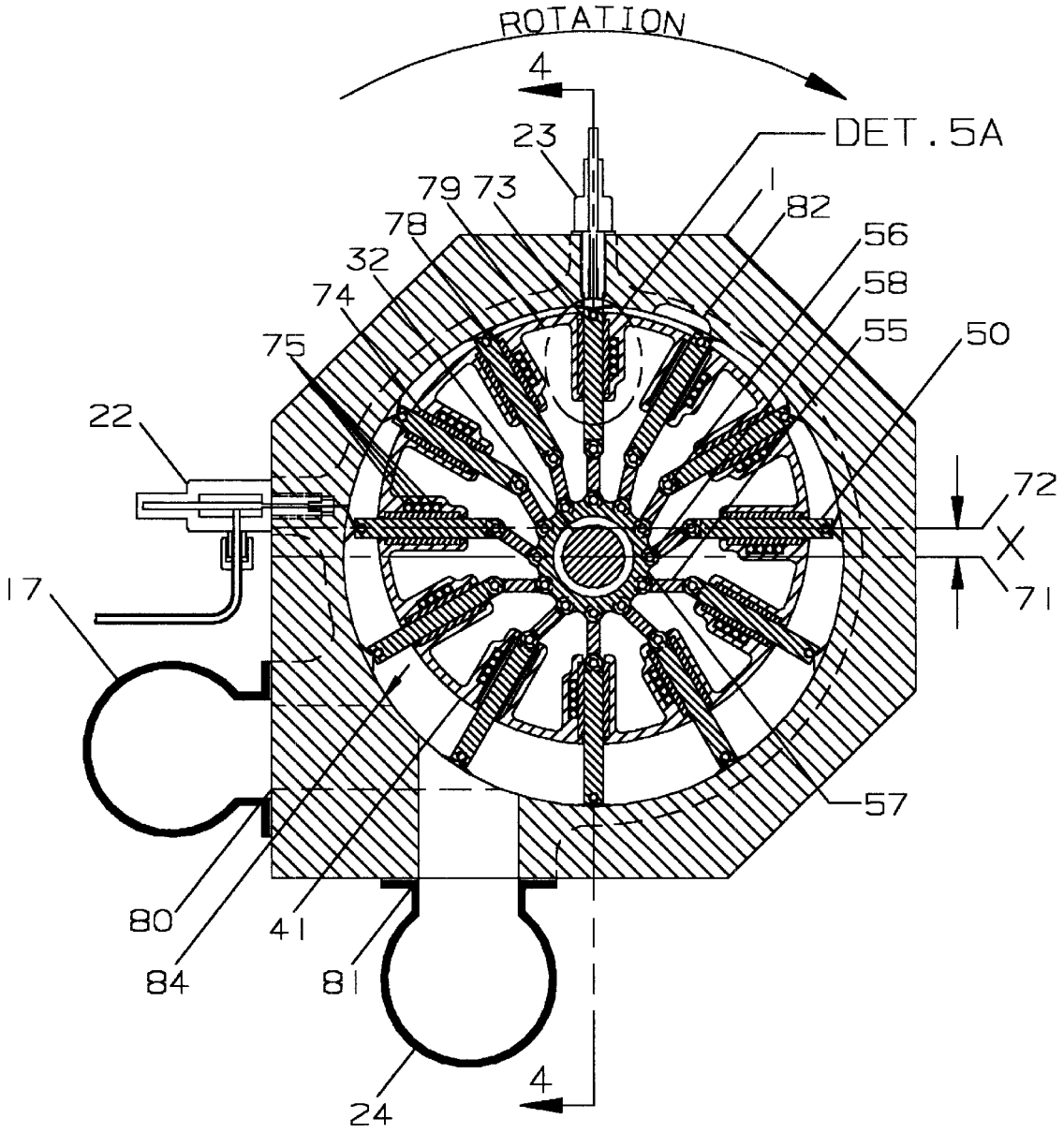
FIG. 5 is a cross section close to the middle of the axial length to illustrate the radial disposition of significant internal components.

With reference to FIG. 5, DET. 5A, and DET. 5B, rotational axis 71 of rotational shaft 32 is coincident with the axis of the bore 84 of containment cylinder 1. Rotational axis 72 of rotational armature 41 and rotational axis 71 are separated by radial distance "X." Rotational armature 41 features a radial vane slot 73 extending through its radial thickness at each of twelve centers equidistantly spaced around its outer periphery and. Within each said radial vane slot 73 a set of four radial springs 75 resiliently constrain said radial vane 50 between two radial vane linear bearings 74. The bearing surface of each said linear bearing 74 incorporates horizontal grooves 76 and vertical grooves 77 to facilitate surface lubrication and ventilation. One radial vane edge seal 78 is secured on the radially outermost axial edge of each said radial vane 50. One hinge pin 56 secures the radially outermost axial edge of one articulated radial vane extension 55 to each said radial vane 50. One hinge pin 58 secures the radially innermost axial edge of each said articulated radial vane extension 55 to radial vane retainer 57. Rotational armature 41 also features one surface area augmentation slot 79 equidistantly interspaced between each set of two adjacent said radial vane slots 73 and proportioned to radially extend partially through its radial thickness from its inner periphery. Port 80 provides conduit for combustion air from manifold 17 through the wall of containment cylinder 1. Port 81 provides conduit for discharge of combustion product to manifold 24. Port 82 provides conduit of combustion product to maintain controlled continuous combustion. Fuel injector 22 provides conduit for induction of fuel and igniter 23 provides conduit for electrical power for combustion initiation.

Figure 6:
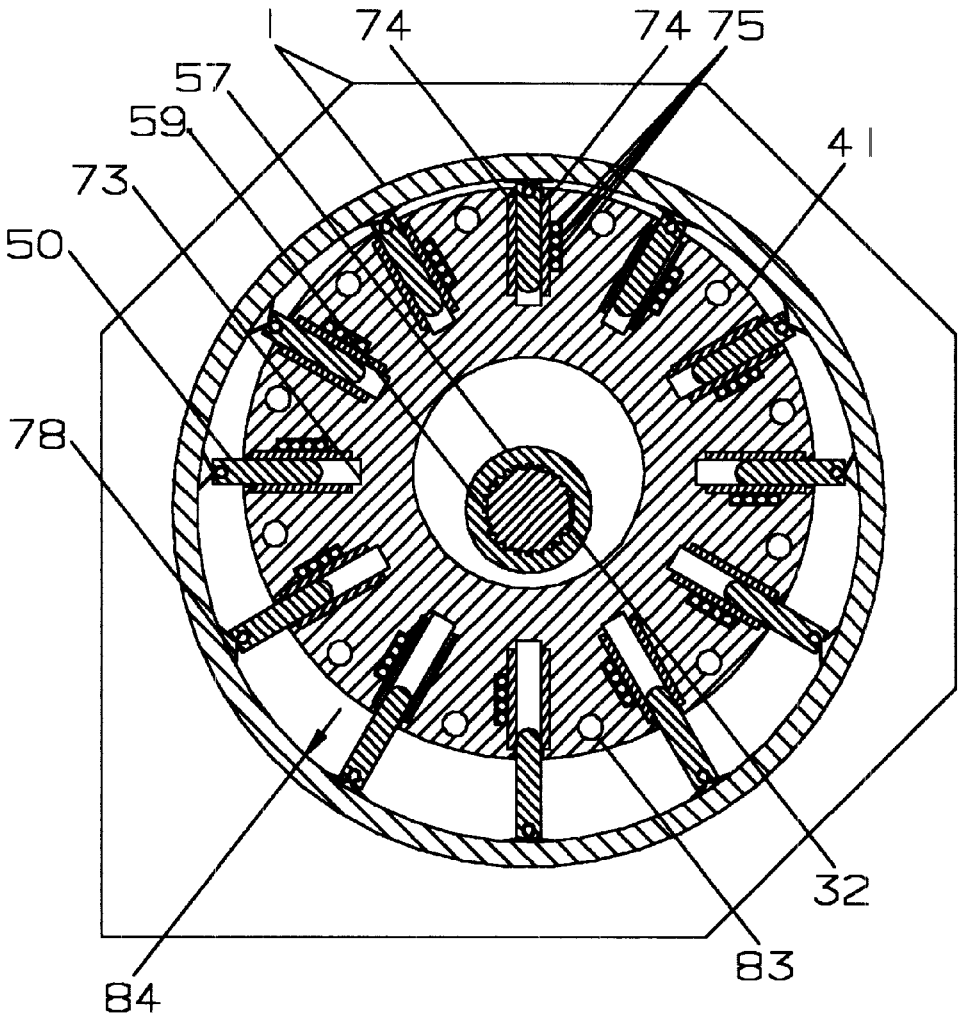
FIG. 6 is a cross section close to the end of the rotational armature to illustrate the arrangements for support of radial vanes close to their axial ends and the arrangement of ports for conduit of internal thermal control and lubrication media.

With reference to FIG. 6, the radial thickness of rotational armature 41 is increased at each axial end and the radial width of each radial vane slot 73 is reduced to extend only partially through its radial thickness. The radial width of each radial vane 50 is reduced at each axial end to be compatible with the local geometry of said radial vane slot 73. Each said radial vane 50 is installed between two radial bearing inserts 74 and resiliently constrained by four radial springs 75 as previously discussed. A number of axial ports 83 provide conduit for movement of internal thermal control and lubrication media. Radial vane retainer 57 is concentrically installed on rotational shaft 32 and rotationally secured by spline 59.

Figure 7:
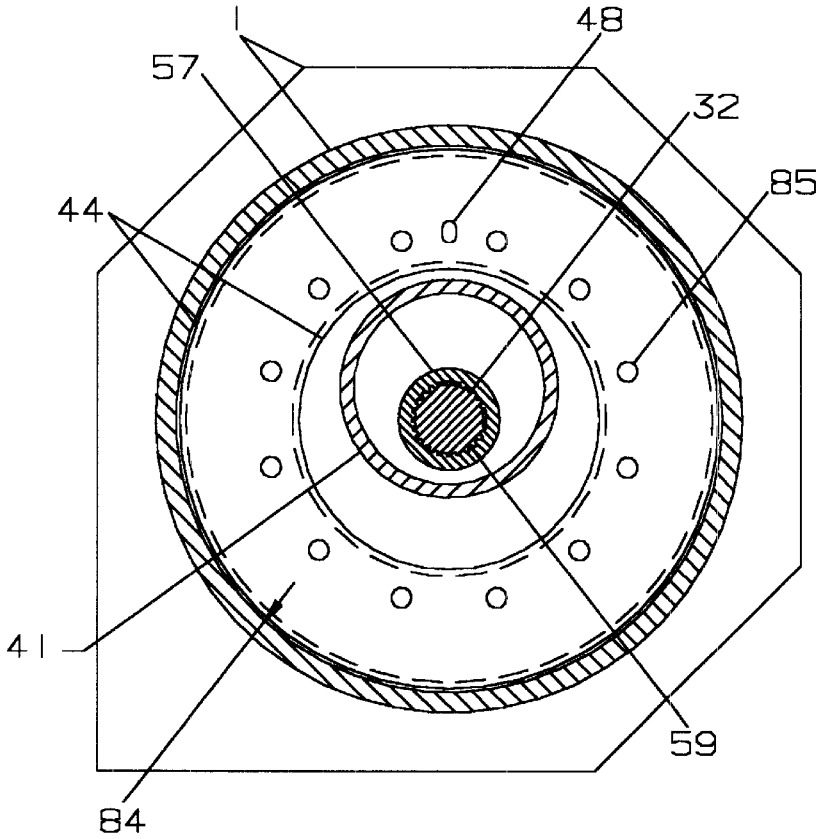
FIG. 7 is a cross section at the inside face of the sealing ring to illustrate the integration of said sealing ring and containment cylinder and the arrangement ports for conduit of internal thermal control and lubrication media.

With reference to FIG. 7, the outer diameter of axial seal ring 44 is proportioned to maintain a close tolerance rotationally sliding fit with containment cylinder bore 84. The inner periphery of said axial seal ring 44 is proportioned to maintain radial clearance from the outer periphery of rotational armature 41. Axial ports 85 provide conduit for movement of internal thermal control and lubrication media. Axial detent opening 48 is arranged to accommodate one radial vane detent protrusion as previously discussed. Radial vane retainer 57 is concentrically installed on rotational shaft 32 and rotationally secured by closely fitted spline 59.

With reference to FIG. 8 and DET. 8A, axial spring 52 is a quasi-flat ring with its outer diameter proportioned to maintain a small distance of separation with the inside surface of seal ring flange 45 and its inner diameter proportioned to maintain a sliding fit with the outer surface seal ring flange 46 Said axial spring 52 features a semi-independent radial spring segment 86 at each of twenty-four equidistantly spaced radial centers. Each said spring segment 86 is integrally secured on a common root 87 and, in the axial plane, is configured as a single arc. For the purpose of this disclosure annular axial compression spring 52 is illustrated as a single entity however a multiplicity of annular axial spring entities may be selected to fulfill particular service requirements. Arrangements of other illustrated features were discussed in prior paragraphs.

Figure 9:
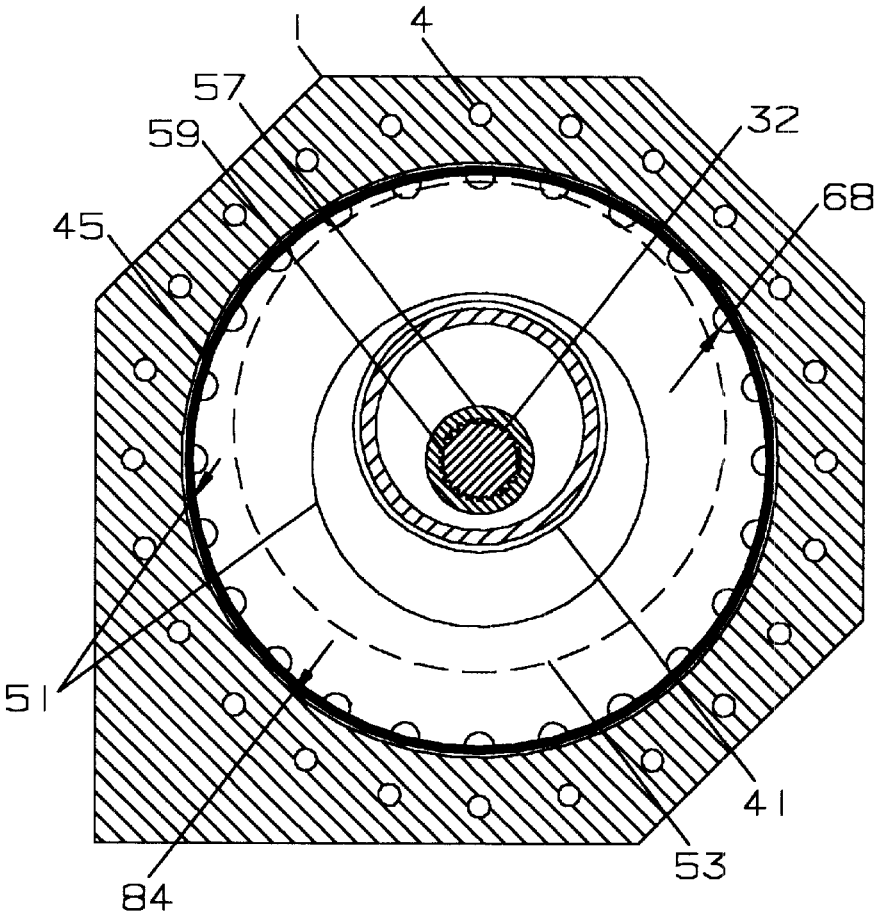
FIG. 9 is a cross section at the inside face of one wear ring to illustrate the interfaces of said wear ring with other contiguous axial end components.

With reference to FIG. 9, the outer diameter of wear ring 51 is proportioned to make a close tolerance sliding fit with the inside surface of seal ring flange 45 and its inner diameter proportioned to maintain a radial clearance with rotational armature 41. Said wear ring 51 is axially constrained through axial face contact with axial retainer ring 53. Axial ports 68 provide conduit for movement of internal thermal control and lubrication media. Arrangements of other illustrated features were discussed in prior paragraphs.

Figure 10:
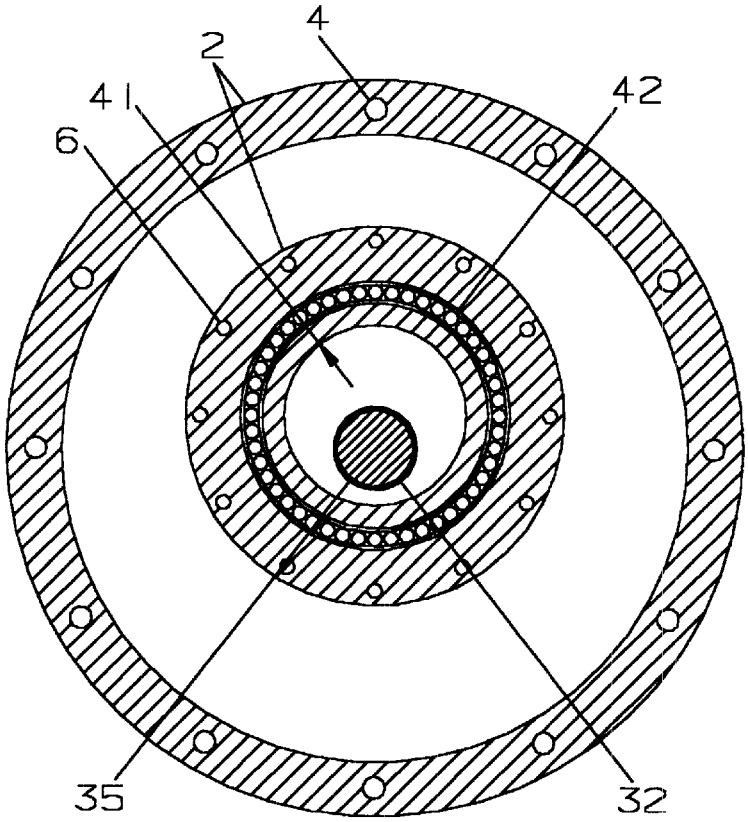
FIG. 10 is a cross section through the mid-length of one end closure structure to illustrate the integration of one rotational armature support bearing.

With reference to FIG. 10, containment cylinder end structure 2 accommodates rotational bearing 42 for support of rotational armature 41. Arrangements of other illustrated features were discussed in prior paragraphs.

Figure 11:
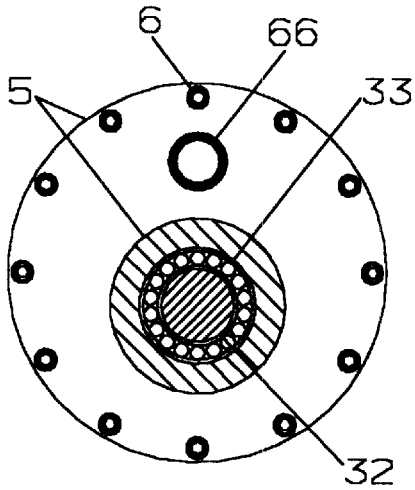
FIG. 11 is a cross section through one bearing carrier to illustrate the integration of one rotational shaft support rotational bearing and the port for induction of internal thermal control and lubrication media.

With reference to FIG. 11, bearing carrier 5 accommodates one rotational bearing 33 for support of rotational shaft 32 and port 66 for conduit for induction of internal thermal control and lubrication media. Arrangements of other illustrated features were discussed in prior paragraphs.

Figure 12:
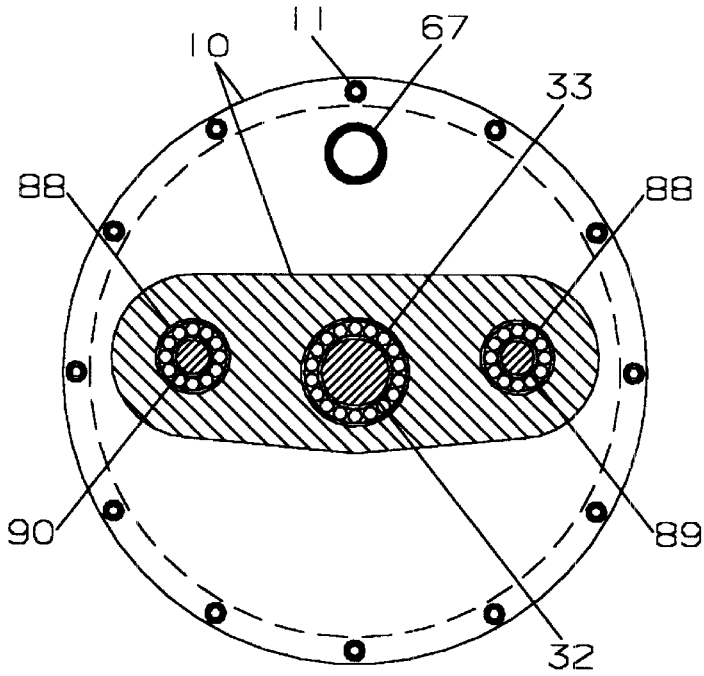
FIG. 12 is a cross section through one bearing carrier to illustrate the arrangement of rotational bearings for the rotational shaft, synchronizing gear shaft, and auxiliary drive shaft and the arrangement of the port for extraction of thermal control media.

With reference to FIG. 12, gear case 10 accommodates one rotational bearing 33 for support of rotational shaft 32 and one rotational bearing 88 each for support of auxiliary rotational shafts 89 and 90. Port 67 provides conduit for discharge of internal thermal control media. Other illustrated features were discussed in prior paragraphs.

Figure 13:
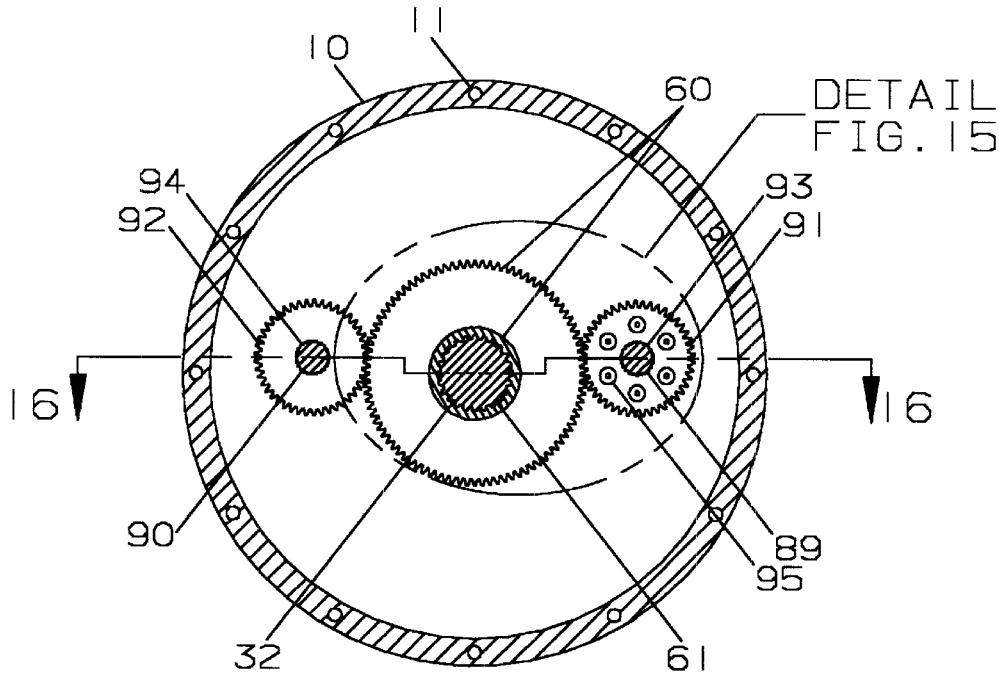
FIG. 13 is a cross section through the gear case to illustrate the integration of the rotational shaft synchronizing gears and auxiliary drive gear.

With reference to FIG. 13, rotational shaft main synchronizing gear 60 is coaxially installed on rotational shaft 32 and rotationally secured by spline 61. Said rotational shaft main synchronizing gear 60 meshes with rotational shaft synchronizing coupling gear 91 and with auxiliary drive gear 92. Said rotational shaft synchronizing coupling gear 91 is coaxially installed on auxiliary rotational shaft 89 and rotationally secured by spline 93. Said auxiliary drive gear 92 is coaxially installed on auxiliary rotational shaft 90 and rotationally secured by spline 94. Coupling gear lock screws 95 will be discussed later. Other illustrated features were discussed in prior paragraphs.

Figure 14:
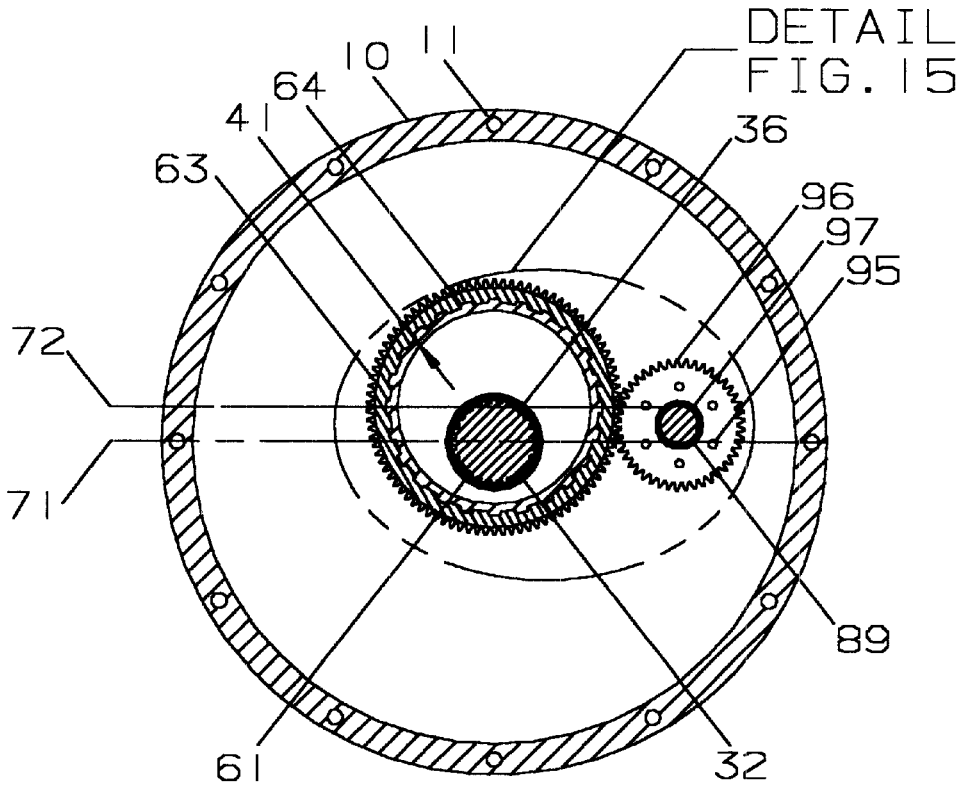
FIG. 14 is a cross section through the gear case to illustrate the integration of the rotational armature synchronizing gears.

With reference to FIG. 14, rotational armature main synchronizing gear 63 is coaxially installed on rotational armature 41 and rotationally secured by spline 64. Said rotational armature main synchronizing gear 63 meshes with rotational armature synchronizing coupling gear 96. Said rotational armature synchronizing coupling gear 96 is secured on closely fitted bushing 97 and coaxially installed on said auxiliary rotational shaft 89. Coupling gear lock screws 95 will be discussed later. Other illustrated features were discussed in prior paragraphs.

With reference to FIG. 15 and DET. 15A, as previously noted said rotational shaft main synchronizing gear 60 meshes with rotational shaft synchronizing coupling gear 91 and rotational armature main synchronizing gear 63 meshes with said rotational armature synchronizing coupling gear 96. Said rotational shaft synchronizing coupling gear 91 and said rotational armature synchronizing coupling gear 96 are concentrically installed on auxiliary rotational shaft 89. The vertical separation of rotational shaft axis 71 from rotational armature axis 72 incurs an angular displacement 98 between the radial reference axis 99 of said rotational shaft synchronizing coupling gear 91 and the radial reference axis 100 of said rotational armature synchronizing coupling gear 96. For the purpose of this disclosure said angular displacement 98 is accommodated by rotational adjustment of said rotational armature synchronizing coupling gear 96 on bushing 97. Coupling gear lock screws 95 rigidly connect said rotational shaft synchronizing coupling gear 91 and said rotational armature synchronizing coupling gear 96 subsequent to rotational adjustment. Alternatively said angular displacement 98 may be accommodated by adjustments in the angular relationship between gear teeth and spline in any one of the gear components.

Figure 16:
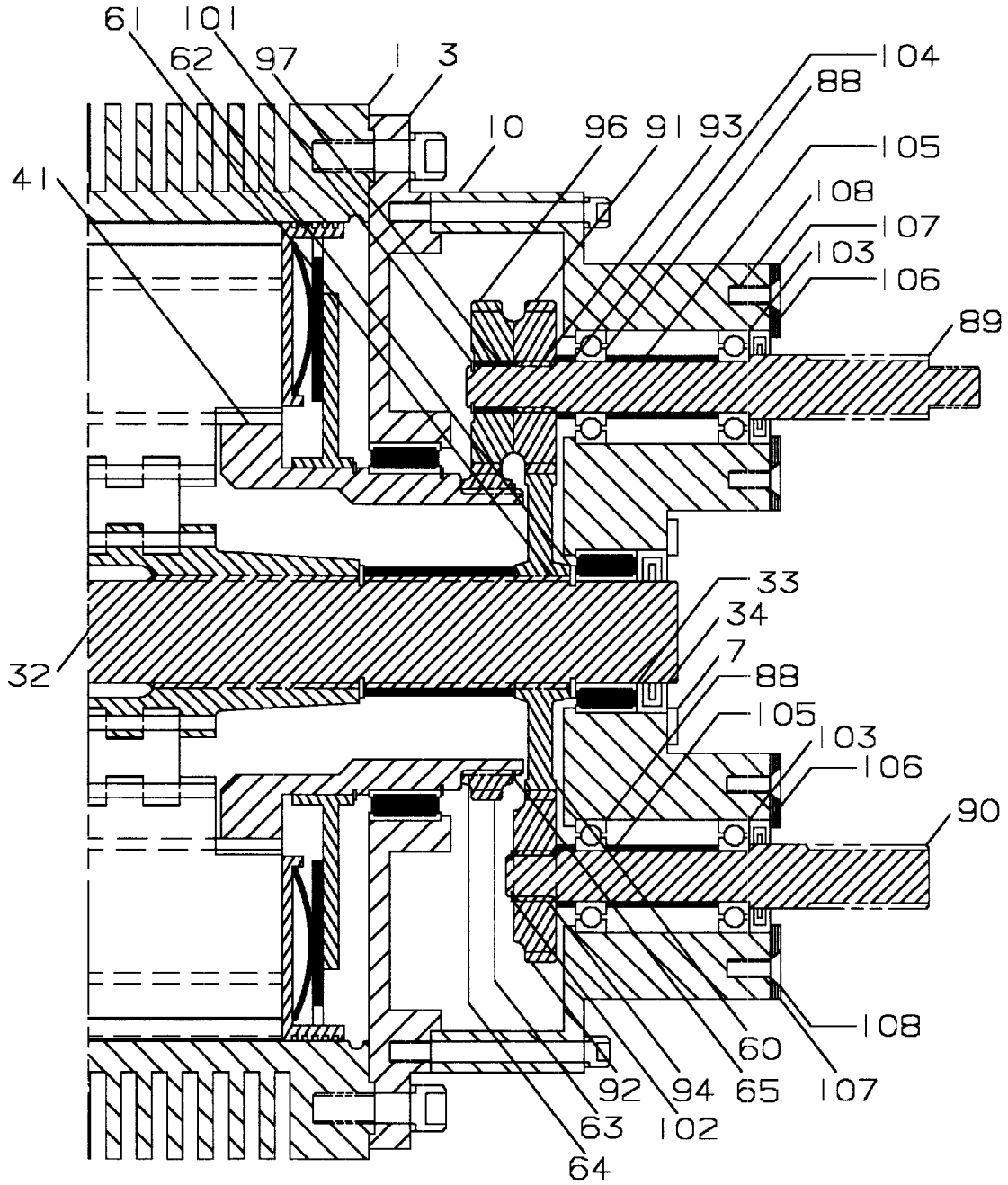
FIG. 16 is a horizontal compound sectional plan view to illustrate the axial and lateral disposition and integration of synchronization and auxiliary drive gears and directly associated components.

With reference to FIG. 16, the axial end of rotational shaft 32 is radially constrained by rotational bearing 33. Said rotational bearing 33 and bearing seal 34 are constrained within gear case structure 10 by bearing retainer 7. Rotational shaft main synchronizing gear 60 is coaxially installed on rotational shaft 32, rotationally secured by spline 61, and axially secured by retainer 62. Rotational armature main synchronizing gear 63 is coaxially installed on rotational armature 41, rotationally secured by spline 64, and axially secured by retainer 65. Auxiliary rotational shaft 89 and auxiliary rotational shaft 90 are each individually and independently constrained by rotational bearings 88 and 103. Concentric rotational bearings 88 and 103 are axially constrained by concentric shaft collars 104 and 105 and axially secured by bearing seal 106, bearing retainer 107, and machine screws 108. Rotational shaft synchronizing coupling gear 91 is concentrically installed on auxiliary rotational shaft 89 and rotationally secured by spline 93. Rotational armature synchronizing coupling gear 96 is concentrically installed on auxiliary rotational shaft 89 and radially constrained by rotational bushing 97. Said Rotational shaft synchronizing coupling gear 91 and said armature synchronizing coupling gear 96 are axially constrained by axial retainer 101. Auxiliary power drive gear 92 is concentrically installed on auxiliary rotational shaft 90, rotationally secured by spline 94, and axially constrained by axial retainer 102. Other illustrated features were discussed in prior paragraphs.

Figure 17:
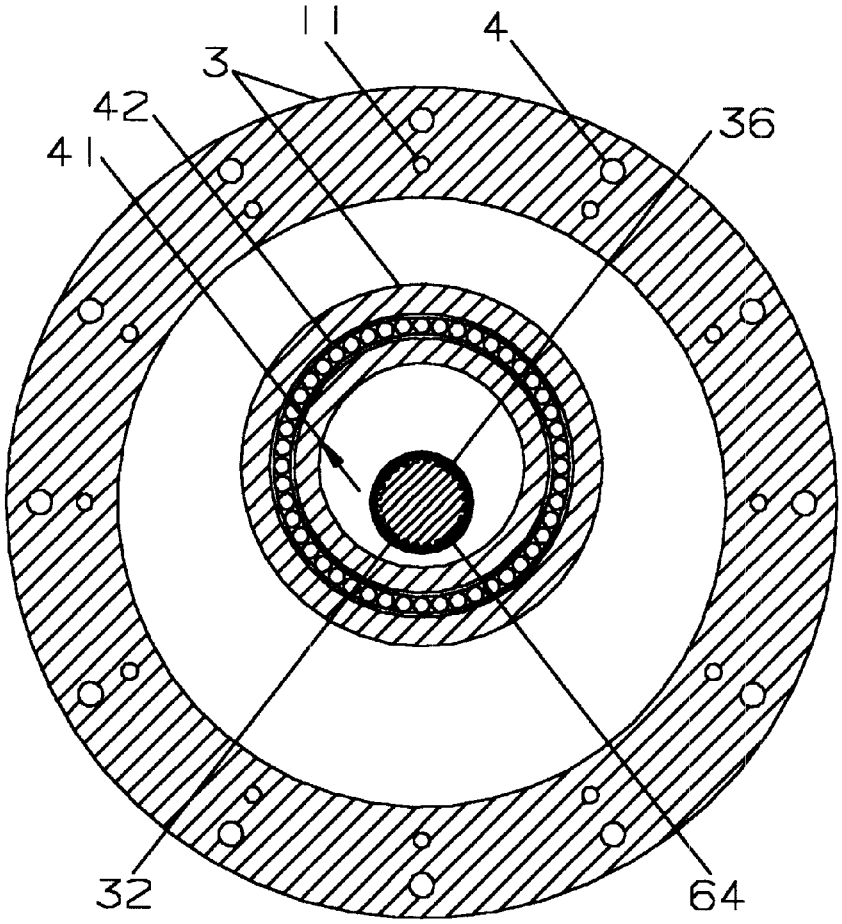
FIG. 17 is a cross section through one end closure structure to illustrate the integration of one rotational armature rotational bearing.

With reference to FIG. 17, rotational armature 41 is radially constrained by rotational armature support bearing 42 secured in end closure structure 3. Other illustrated features were discussed in prior paragraphs.

Figure 18:
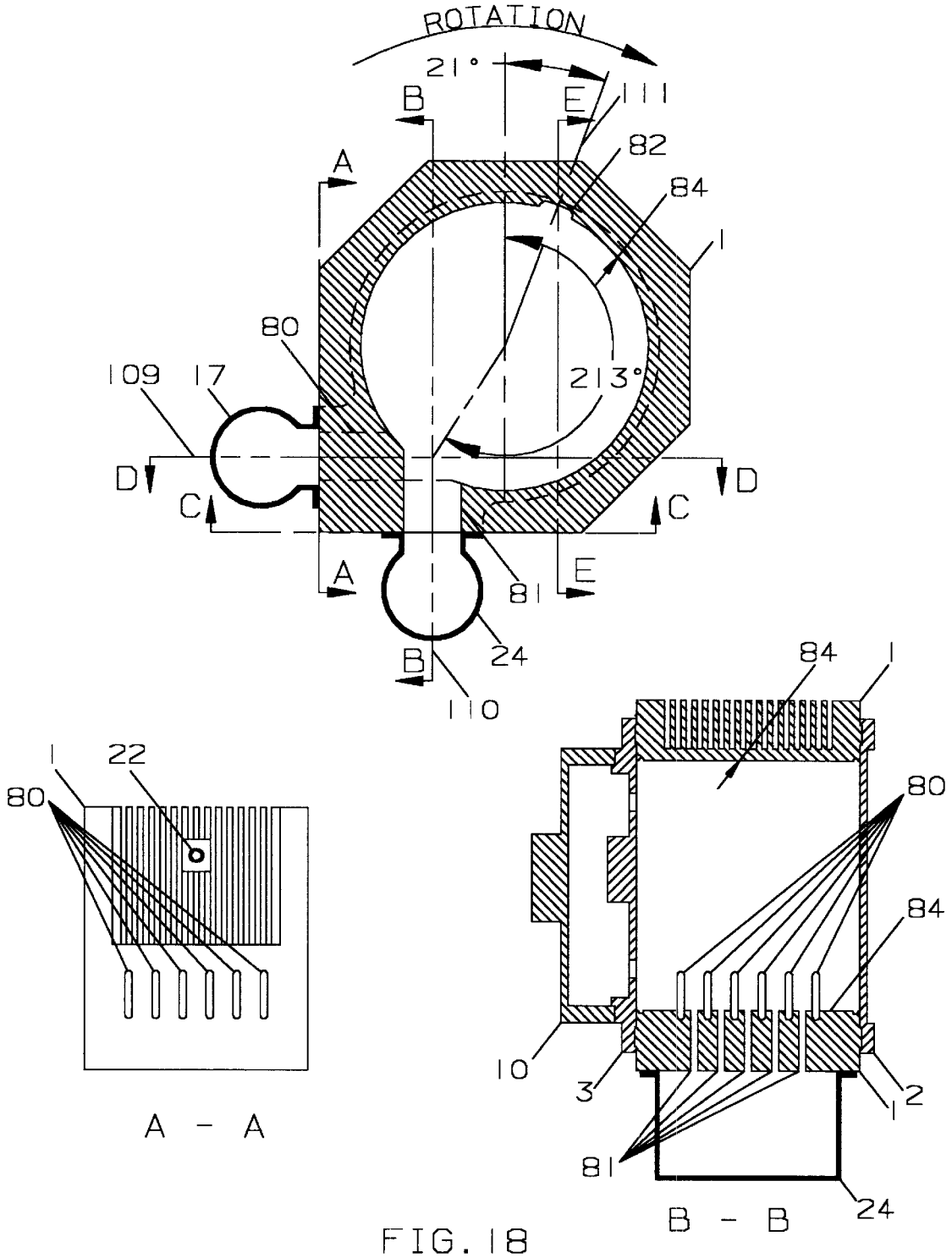
FIG. 18 is a cross section through the stationary containment cylinder to illustrate the general arrangement and details of the combustion air induction ports, combustion product discharge ports, and continuous combustion ports.

With reference to FIG. 18, axis 109 of combustion air induction port 80 and axis 110 of combustion product discharge port 81 are arranged horizontally and vertically respectively. Said axes intersect at a rotational angle of approximately 213 degrees from top dead center in the direction of rotation and at a radial distance equal to approximately 90% of the radius of containment cylinder bore 84. Said combustion air induction port 80 and said combustion products discharge port 81 each comprise a group of elongated openings uniformly distributed throughout the axial length of containment cylinder 1 and extending through its wall thickness. The elongated openings of said combustion products discharge port 81 are axially interspersed between the openings of said combustion air induction port 80. Continuous combustion port 82 axially centered on radial axis 111 consists of a group of peripherally elongated channels uniformly dispersed within the axial length of containment cylinder 1 and extending partially through its radial thickness.

Figure 19:
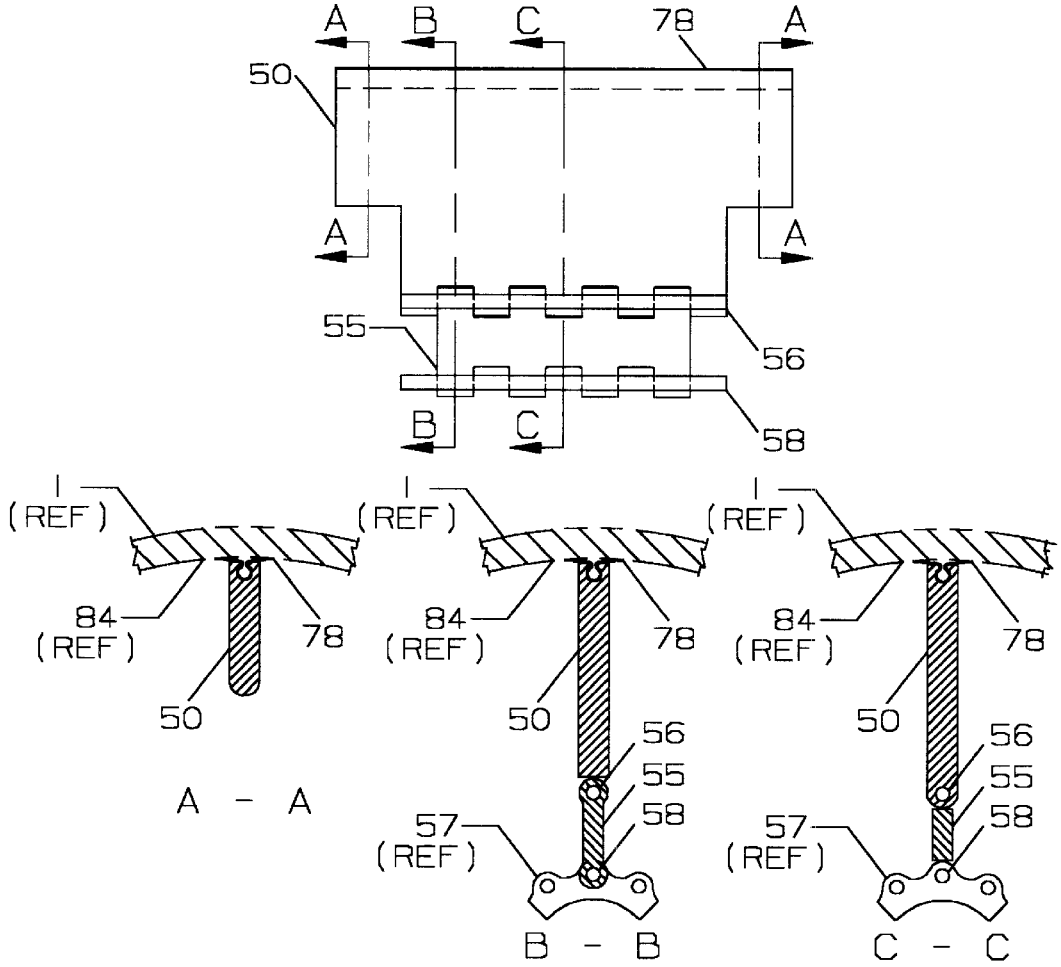
FIG. 19 is an elevation of one typical radial vane to illustrate significant geometric and assembly features of its directly associated components.

With reference to FIG. 19, each radial vane assembly consists of one radial vane 50, one articulated radial vane extension 55, and one radial vane edge seal 78. Each said radial vane 50 is a quasi-rectangular flat panel structure configured to feature one half of a hinge connection along its radially innermost axial edge. Each said articulated radial vane extension 55 is a quasi-rectangular flat panel structure configured to feature one half of a hinge connection along each axial edge. The radially innermost axial edge of each said radial vane 50 is secured to one axial edge of one articulated radial vane extension 55 by one hinge pin 56. The innermost axial edge of each articulated radial vane extension 55 is secured to radial vane retainer 57 by hinge pin 58. One said radial vane edge seal 78 is secured in the radially outermost edge of each said radial vane 50. Said radial vane edge seal 78 consists of a relatively thin spring-grade steel structure configured to feature an axial bifurcation on its outer peripheral edge and proportioned to maintain resilient contact with containment cylinder bore 84. Said radial vane edge seal 78 is secured to radial vane 50 by a closely fitted journal bearing interface proportioned to allow partial relative rotation of said radial vane edge seal 78 relative to radial vane 50.

Figure 20:
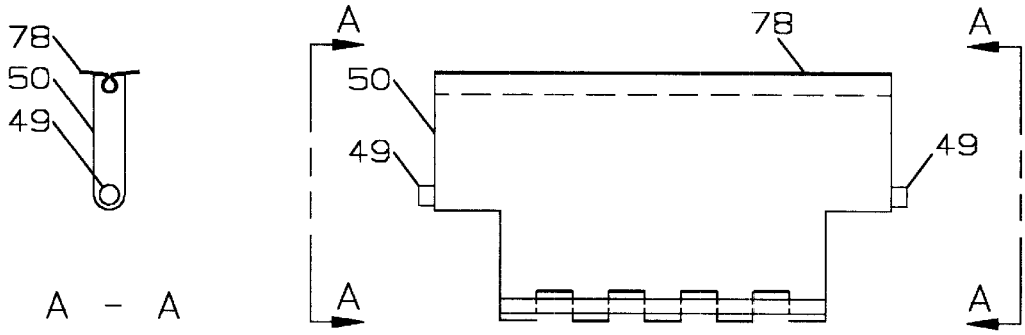
FIG. 20 is an elevation of one radial vane to illustrate the installation of one detent protrusion on each axial end of one radial vane.

With reference to FIG. 20, one detent pin 49 configured as a solid cylindrical structure with a circular cross section is integrally secured at each axial end of one radial vane 50.

I claim as my invention:

1. A gear synchronized articulated vane rotary machine for the production of rotational mechanical energy by internal combustion of liquid or gaseous fuel and comprising:

a stationary containment cylinder with a circular bore installed with axially interspersed combustion air inlet ports and combustion product discharge ports and installed with ports for induction of fuel, for combustion initiation, and for sustaining continuous combustion;

an end closure structure mechanically secured at each axial end of said containment cylinder and installed with ports for induction and discharge of internal thermal control and lubrication media, a rotational armature configured as a hollow structural annulus with a circular cross-section, diametrically proportioned to equal approximately eighty five percent of the bore of said containment cylinder installed with a reduced diameter axial extension at each axial end;

a low-friction rotational bearing installed on each said reduced diameter axial extension of said rotational armature and arranged to constrain said rotational armature within the bore of said containment cylinder with an axis of rotation parallel to but radially separated from, the axis of said bore;

a surface area augmentation slot installed on the inner periphery of said rotational armature at each of twelve equidistant radial centers with each said area augmentation slot proportioned to extend partially through its axial length and radial thickness;

a radial vane slot equidistantly interspersed between said area augmentation slots on the inner periphery of said rotational armature with each said radial vane slot proportioned to extend through its axial length and radial thickness;

a radial vane support linear bearing slot installed in each face of each said radial vane slot with each said radial vane support linear bearing slot proportioned to extend through the axial length of said radial vane slot and partially through its radial width;

a radial compression spring slot installed in one face of each said radial vane support linear bearing slot with each said radial compression spring slot proportioned to extend through the axial length of said linear bearing slot and partially through its radial width;

a radial vane installed within each said radial vane slot with the outer axial edge of each said radial vane configured to accommodate a radial vane-edge seal and its inner axial edge configured as one side of a pivotal hinge;

a radial vane support linear bearing installed within each said radial vane support linear bearing slot with each said radial vane support linear bearing proportioned to maintain sliding contact with contiguous said radial vane;

a radial compression spring installed at each of four equidistant centers within each said radial compression spring slot with each said radial compression spring radially proportioned to maintain resilient pressure contact between the adjacent said radial vane support linear bearing and contiguous said radial vane;

a radial vane articulated extension pivotally secured to the inner axial edge of each said radial vane and radially proportioned to maintain a small distance of separation between the outer axial edge of said radial vane and the bore of said containment cylinder;

a radial vane edge seal secured to the outer axial edge of each said radial vane with said radial vane edge seal axially bifurcated on its outer peripheral edge and radially proportioned to maintain resilient contact with the bore of said containment cylinder;

a radial vane detent pin constructed as a circular structural cylinder axially installed and integrally secured at each axial end of one said radial vane;

a rotational shaft axially proportioned to extend through the axial length of said rotational armature and each said end closure structure with its axial ends configured to interface with other rotational power components;

a low-friction rotational bearing installed in each said end closure structure proportioned and arranged to collectively constrain said rotational shaft with a rotational axis concentric with the bore axis of said containment cylinder;

a radial vane retainer coaxially installed and rotationally secured on said rotational shaft and pivotally secured to the inner axial edge of one said articulated radial vane extension at each of twelve radial centers equidistantly spaced around its outer periphery;

a rotational armature main synchronizing gear coaxially secured on the axial end of one said rotational armature axial extension;

a rotational shaft main synchronizing gear coaxially secured on said rotational shaft and proportioned to be identical in pitch circle diameter and tooth pitch to said rotational armature main synchronizing gear;

a rotational shaft synchronizing coupling gear coaxially secured on an auxiliary rotational shaft and proportioned and arranged to mesh with said rotational shaft main synchronizing gear;

a rotational armature synchronizing coupling gear coaxially installed and axially secured on said auxiliary rotational shaft, proportioned to be identical in pitch circle diameter to said rotational shaft synchronizing coupling gear, and arranged to mesh with said rotational armature main synchronizing gear;

an interlocking machine screw at each of four equidistantly spaced radial centers on the axial face of said rotational shaft synchronizing coupling gear and proportioned to rotationally integrate said rotational shaft synchronizing coupling gear and said rotational armature synchronizing coupling gear;

an axial seal ring installed at each axial end of the bore of said containment cylinder with each said axial seal ring diametrically proportioned to make a sliding fit within the bore of said containment cylinder and collectively close the axial ends of all said radial vane slots and with each said axial seal ring installed with an axially extended flange on its outer periphery, one radially elongated radial vane detent slot, and with thermal control ports;

an axial retainer ring concentrically installed and axially secured on each said rotational armature axial extension and diametrically proportioned to rotate within the peripheral flange of said axial seal ring;

a wear ring installed between the axially opposing faces of one said axial retainer ring and one said axial seal ring with said wear ring diametrically proportioned to maintain a sliding fit within the peripheral flange of said axial seal ring and installed with thermal control ports;

an axial compression spring installed between one said wear ring and one said axial seal ring with said axial compression spring diametrically proportioned to be accommodated within the peripheral flange of said axial seal ring and axially proportioned to maintain resilient bearing contact between the axial face of its adjacent axial seal ring and one axial end of said rotational armature;

a fan and air distribution system suitably proportioned and installed to provide a controlled supply of atmospheric air for internal combustion and internal thermal control;

an externally powered rotational device suitably proportioned installed for initiation of rotation;

an externally powered ignition system suitably proportioned and installed for initiation of internal combustion.

* * * * *